US009748716B2

(12) United States Patent
Uehara et al.

(10) Patent No.: US 9,748,716 B2
(45) Date of Patent: Aug. 29, 2017

(54) CONNECTION STRUCTURE FOR TERMINAL FITTING

(71) Applicant: YAZAKI CORPORATION, Tokyo (JP)

(72) Inventors: Takehiko Uehara, Shizuoka (JP); Takatatsu Yamamoto, Shizuoka (JP); Keiichi Mita, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/363,647

(22) Filed: Nov. 29, 2016

(65) Prior Publication Data

US 2017/0155220 A1 Jun. 1, 2017

(30) Foreign Application Priority Data

Nov. 30, 2015 (JP) ..... 2015-233573

(51) Int. Cl.
*H01R 25/00* (2006.01)
*H01R 4/18* (2006.01)

(52) U.S. Cl.
CPC ..... *H01R 25/003* (2013.01); *H01R 4/185* (2013.01)

(58) Field of Classification Search
CPC ..... H01R 25/003; H01R 4/185; H01R 4/66; H01R 13/28; H01R 11/12
See application file for complete search history.

(56) References Cited

U.S. PATENT DOCUMENTS 5,759,055 A * 6/1998 Colantuano ..... H01R 9/18 439/287
6,786,751 B2 * 9/2004 Maeda ..... H01R 11/12 439/287
7,384,281 B2 * 6/2008 Matsuoka ..... H01R 4/183 439/92
8,105,121 B2 * 1/2012 Miyamoto ..... H01R 4/646 439/883
9,039,435 B2 * 5/2015 Horiuchi ..... H01R 4/64 439/287
9,153,880 B2 * 10/2015 Omori ..... H01R 4/64
9,300,093 B2 * 3/2016 Omori ..... H01R 4/64
9,520,657 B2 * 12/2016 Lawson ..... H01R 11/12
(Continued)

FOREIGN PATENT DOCUMENTS

JP 2012-190749 A 10/2012

*Primary Examiner* — Alexander Gilman
(74) *Attorney, Agent, or Firm* — Kenealy Vaidya LLP

(57) ABSTRACT

A connection structure for a terminal fitting includes the terminal fitting including a terminal body and a plurality of terminal connection portions extending from the terminal body, and connection terminals connected to electric wires. Each of the connection terminals include a pair of fastening caulking pieces. The pair of fastening caulking pieces are caulked with opposite side portions of a corresponding one of the terminal connection portions from outside so as to roll up the opposite side portions so that the connection terminal is caulked and fastened to the terminal fitting. The terminal connection portion and the connection terminal include an engagement mechanism that prevents the terminal connection portion from detaching from the fastening caulking pieces. The terminal fitting is connected to the electric wires through the connection terminals.

4 Claims, 16 Drawing Sheets

(56) References Cited

U.S. PATENT DOCUMENTS

| | | | | |
|---|---|---|---|---|
| 9,543,669 | B2 * | 1/2017 | Broughton | H01R 4/30 |
| 2011/0111640 | A1 * | 5/2011 | Hara | H01R 4/64<br>439/660 |

* cited by examiner

CONNECTION STRUCTURE FOR TERMINAL FITTING

CROSS REFERENCE TO RELATED APPLICATIONS

This application claims priority from Japanese Patent Application No. 2015-233573 filed on Nov. 30, 2015, the entire contents of which are incorporated herein by reference.

BACKGROUND OF THE INVENTION

Field of the Invention

The present invention relates to a connection structure of a terminal fitting.

Description of Related Art

There has been known a connection structure in which connection plates of a plurality of terminal fittings, to which grounding electric wires have been connected, are put on top of one another, a common bolt is inserted into mounting holes provided in the connection plates to thereby bolt and fasten the connection plates to a grounding surface (such as a predetermined place of a vehicle body), so that the grounding electric wires can be conductively connected to the grounding surface in a lump through the terminal fittings put on top of one another (for example, see Patent Literature 1:
JP-A-2012-190749).

[Patent Literature 1] JP-A-2012-190749

According to a related art, in a structure in which terminal fittings put on top of one another are fastened by a bolt, the terminal fittings connected to grounding electric wires respectively are put on top of one another and fastened by the bolt. Therefore, the weight increases as the number of grounding electric wires increases. In addition, the thickness of the terminal fittings put on top of one another increases as the number of grounding electric wires increases. Thus, a large space for receiving the terminal fittings has to be secured above the grounding surface. In addition, much working time is required for fastening work while adjusting the nut length or the bolt length in accordance with the terminal fittings to be put on top of one another.

In addition, in order to conductively connect a plurality of grounding electric wires in a lump, it can be also considered to use a joint connector in which connection terminals connected to the grounding electric wires are inserted into a housing accommodating joint terminals to thereby conductively connect the grounding electric wires in a lump through the joint terminals while holding the connection terminals inside the housing. However, in the case of the joint connector, a holding mechanism (such as a lock lance) for holding the connection terminals inside the housing has to be provided. It is therefore difficult to miniaturize the housing. In addition, since the housing provided with the holding mechanism is required, the cost increases inevitably.

In addition, due to fastening by a bolt, reliability in connection may deteriorate after the connection because the bolt is loosened. In this case, when the connection terminals are crimped and fastened to the terminal fittings, a firm connection structure can be obtained. However, when the connection terminals and the terminal fittings are crimped by a crimping machine, there is a fear that their postures cannot be stabilized relatively to each other but a variation may occur in crimping strength.

SUMMARY

One or more embodiments provide a connection structure for a terminal fitting capable of conductively connecting a plurality of electric wires in a lump with high reliability in connection while suppressing weight and saving space.

In an aspect (1), one or more embodiments provide a connection structure for a terminal fitting comprising:

the terminal fitting including a terminal body and a plurality of terminal connection portions extending from the terminal body; and connection terminals connected to electric wires, wherein each of the connection terminals include a pair of fastening caulking pieces, wherein the pair of fastening caulking pieces are caulked with opposite side portions of a corresponding one of the terminal connection portions from outside so as to roll up the opposite side portions so that the connection terminal is caulked and fastened to the terminal fitting, wherein the terminal connection portion and the connection terminal include an engagement mechanism that prevents the terminal connection portion from detaching from the fastening caulking pieces, and wherein the terminal fitting is connected to the electric wires through the connection terminals.

In an aspect (2), the connection structure for the terminal fitting according to the aspect (1), wherein the engagement mechanism includes concave-convex engagement portions respectively provided in opposed surfaces in which the terminal connection portion and the connection terminal abut against each other.

In an aspect (3), the connection structure for the terminal fitting according to the aspect (1), wherein the engagement mechanism includes electric-wire-side side faces of the fastening caulking pieces and engagement protruding portions provided in the terminal connection portions so as to abut against the electric-wire-side side faces.

In an aspect (4), the connection structure for the terminal fitting according to the aspect (1), wherein the engagement mechanism includes engagement protruding portions that are formed in the fastening caulking pieces and engagement concave portions that are formed in fastened caulking pieces erecting on opposite side portions of the terminal connection portions so as to be engaged with the engagement concave portions.

According to the aspect (1), fastening caulking pieces of connection terminals connected to end portions of electric wires are caulked to a plurality of terminal connection portions provided in the terminal fitting. Thus, the connection terminals are fastened to the terminal fitting so that the electric wires can be conductively connected to the terminal fitting in a lump. In this manner, it is not necessary to stack terminal fittings. In comparison with a structure in which terminal fittings connected to electric wires respectively are stacked and fastened for conductive connection, increase in weight of the terminal fitting can be suppressed even when the number of electric wires increases. In addition, since it is not necessary to stack terminal fittings, the thickness of the terminal fitting does not increase even if the number of electric wires to be conductively connected increases. Thus, space saving can be attained.

In addition, since the connection terminals are caulked and fastened to the terminal connection portions of the terminal fitting, it is possible to dispense with a special holding mechanism for holding the connection terminals. Thus, reduction in size and cost can be attained in comparison with a joint connector in which a holding mechanism for holding terminals has to be provided in a housing.

In addition, due to the structure in which separate connection terminals are caulked and fastened to the terminal fitting to be thereby connected thereto, the connection terminals to which electric wires having different diameters have been connected can be caulked and fastened to the terminal connection portions to be thereby conductively connected thereto. That is, electric wires having various sizes can be dealt with without changing the connection forms between the terminal connection portions of the terminal fitting and the fastening connection portions of the connection terminals. In addition, when terminal fittings differing in number of terminal connection portions are prepared, it is possible to easily deal with increase or decrease in number of electric wires to be conductively connected. As a result, any change in number or size of electric wires to be conductively connected can be dealt with by a required minimum variation of terminal fittings.

In addition, due to the structure in which connection terminals are fastened to a plurality of terminal connection portions of the terminal fitting, the connection terminals can be caulked and fastened to the terminal connection portions in accordance with necessity. Thus, the number of electric wires to be conductively connected in a lump can be increased or decreased easily within the range of the number of terminal connection portions.

Further, due to the engagement mechanism provided between each terminal connection portion and a corresponding connection terminal, the terminal connection portion can be prevented from detaching from corresponding fastening caulking pieces. Thus, reliability in mechanical connection is improved in comparison with a structure in which connection is established only by caulking and fastening.

According to the aspect (2), a concave-convex engagement portion is provided as the engagement mechanism in opposed surfaces where each terminal connection portion and a corresponding connection terminal abut against each other. That is, the concave-convex engagement portion can be formed easily in the terminal connection portion and the connection terminal by press working or the like. Thus, increase in working cost can be suppressed.

According to the aspect (3), the engagement protrusion portions of each terminal connection portion abut against electric-wire-side side faces of corresponding fastening caulking pieces, so that the terminal connection portion can be prevented from detaching from the fastening caulking pieces. That is, only if the engagement protrusion portions are provided in each terminal connection portion, an engagement mechanism can be formed, and increase in working cost can be suppressed.

According to the aspect (4), the engagement protrusion portions of the fastening caulking pieces are engaged with the engagement concave portions of corresponding fastened caulking pieces which have been caulked, so that the terminal connection portion can be prevented from detaching from the fastening caulking pieces. That is, the engagement concave portions and the engagement protrusion portions can be formed at the same time as the fastened caulking pieces and the fastening caulking pieces are formed by press working. Thus, increase in working cost can be suppressed.

According to one or more embodiments, it is possible to provide a connection structure for a terminal fitting capable of conductively connecting a plurality of electric wires in a lump with high connection reliability while suppressing weight and saving space.

The invention has been described briefly above. The further details of the invention will be made clearer through with reference to the accompanying drawings.

BRIEF DESCRIPTION OF THE DRAWINGS

FIG. 2A is a perspective view of the terminal fitting and a connection terminal, and FIG. 2B is a plan view of the terminal fitting and the connection terminal.

FIG. 6A is a sectional view taken on line C-C in FIG. 5. FIG. 6B is a sectional view taken on line D-D in FIG. 5. FIG. 6C is a sectional view taken on line E-E in FIG. 5. FIG. 6D is a sectional view taken on line F-F in FIG. 5.

FIG. 8A is a sectional view taken on line A-A in FIG. 1B, showing a state where the fastening caulking pieces have not been fastened yet. FIG. 8B is a sectional view taken on line A-A in FIG. 1B, showing a state where the fastening caulking pieces are being fastened. FIG. 8C is a sectional view taken on line A-A in FIG. 1B, showing a state where the fastening caulking pieces have been fastened. FIG. 8D is a sectional view taken on line B-B in FIG. 1B.

FIG. 9A is a perspective view of the terminal fitting to which grounding electric wires have been connected, and FIG. 9B is a plan view of the terminal fitting to which the grounding electric wires have been connected.

FIG. 10A is a perspective view of the terminal fitting and a connection terminal, and FIG. 10B is a plan view of the terminal fitting and the connection terminal.

FIG. 11A is a sectional view taken on line G-G in FIG. 9B, showing a state where the fastening caulking pieces have not been fastened yet. FIG. 11B is a sectional view taken on line G-G in FIG. 9B, showing a state where the fastening caulking pieces are being fastened. FIG. 11C is a sectional view taken on line G-G in FIG. 9B, showing a state where the fastening caulking pieces have been fastened.

FIG. 12A is a perspective view of the terminal fitting to which grounding electric wires have been connected, and FIG. 12B is a plan view of the terminal fitting to which the grounding electric wires have been connected.

FIG. 15A is a perspective view of the terminal fitting to which grounding electric wires have been connected, and FIG. 15B is a plan view of the terminal fitting to which the grounding electric wires have been connected.

FIG. 17A is a sectional view taken on line J-J in FIG. 15B, showing a state where the fastening caulking pieces have not been fastened yet. FIG. 17B is a sectional view taken on line J-J in FIG. 17B, showing a state where the fastening caulking pieces are being fastened. FIG. 17C is a sectional view taken on line J-J in FIG. 15B, showing a state where the fastening caulking pieces have been fastened.

DETAILED DESCRIPTION

An embodiment of the invention will be described below with reference to the drawings (first embodiment).

First, a connection structure for a terminal fitting according to the first embodiment of the invention will be described.

Figure 1A:
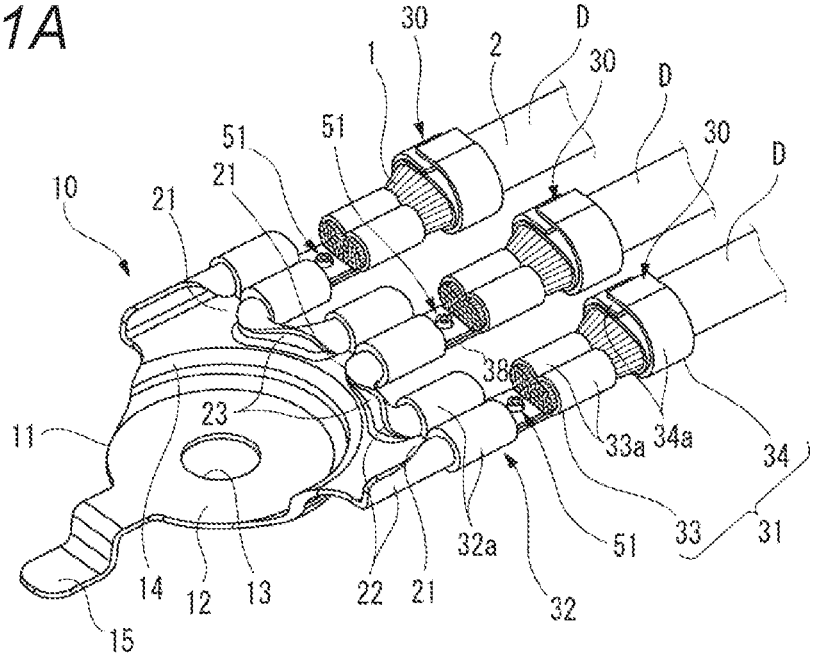
FIG. 1A is a perspective view of the terminal fitting to which grounding electric wires have been connected.
Figure 1B:
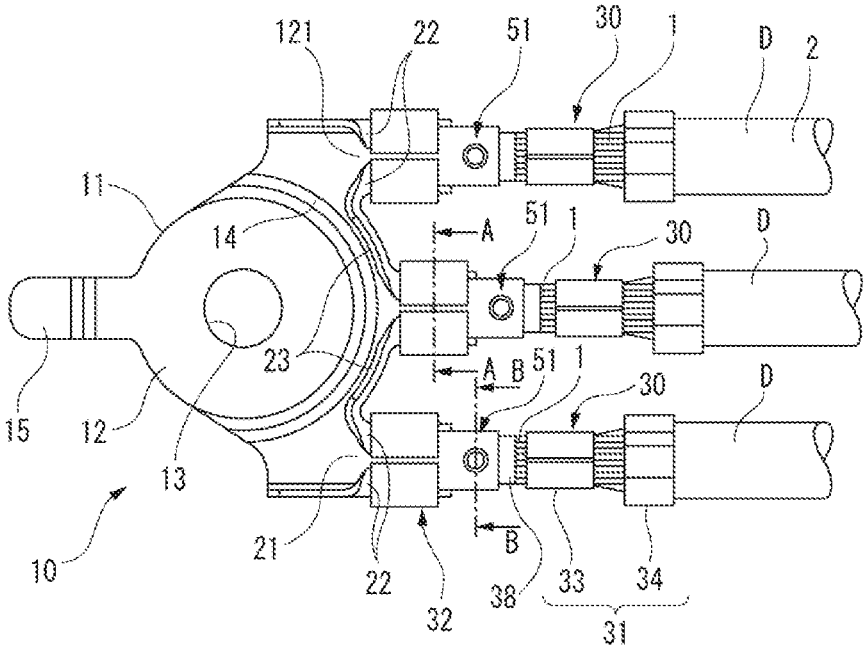
FIG. 1B is a plan view of the terminal fitting to which the grounding electric wires have been connected.

FIGS. 1A and 1B are views for explaining a connection structure for a terminal fitting according to the first embodiment. FIG. 1A is a perspective view of a terminal fitting 10 to which grounding electric wires D have been connected, and FIG. 1B is a plan view of the terminal fitting 10 to which the grounding electric wires D have been connected.

As shown in FIGS. 1A and 1B, terminal connection portions 21 of the terminal fitting 10 and connection terminals 30 are connected in the connection structure of the terminal fitting according to the first embodiment. The terminal fitting 10 is conductively connected to a grounding surface of a body or the like of a vehicle. The connection terminals 30 connected to the terminal fitting 10 are provided in end portions of the grounding electric wires (electric wires) D of on-vehicle circuits (accessories). Each grounding electric wire D has a conductor portion 1, and a jacket 2 covering the conductor portion 1. In the end portion where the grounding electric wire D is connected to the connection terminal 30, the conductor portion 1 is exposed from the jacket 2. In the grounding electric wire D, the conductor portion 1 is conductively connected to the connection terminal 30. In this manner, the grounding electric wires D of the on-vehicle circuits are conductively connected to the grounding surface of the body or the like of the vehicle through the terminal fitting 10. For example, 8 sq. mm grounding electric wires D are connected to the connection terminals 30.

Figure 2A:
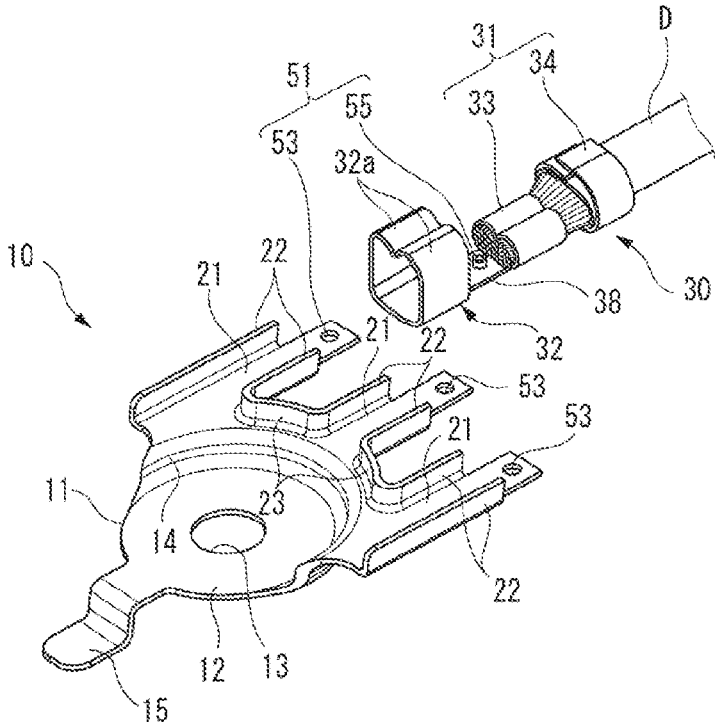
FIGS. 2A and 2B are views for explaining the connection structure of the terminal fitting according to the first embodiment.
Figure 2B:
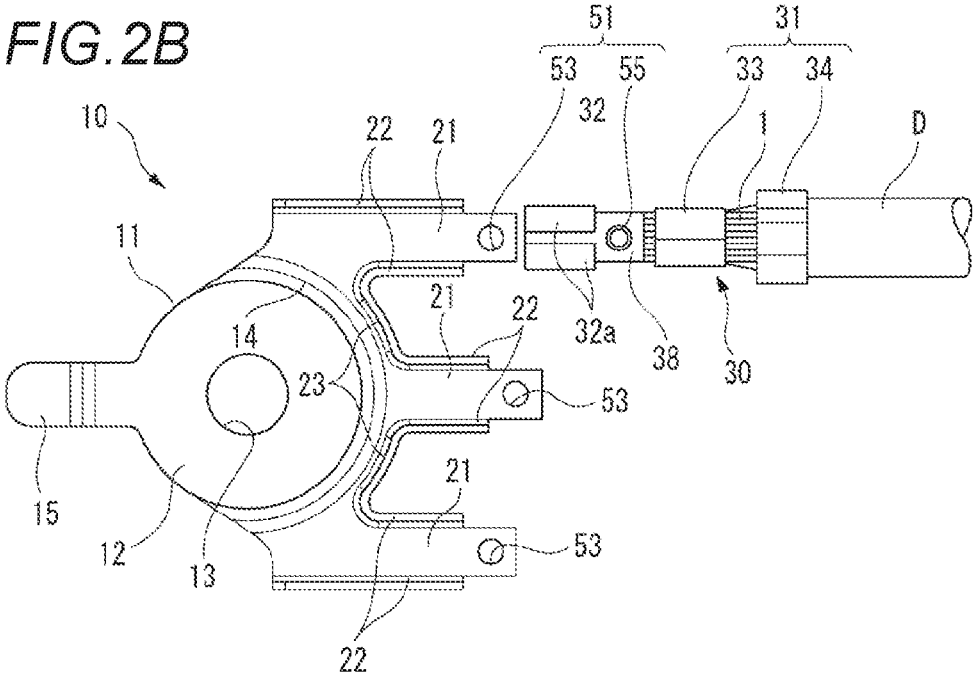
Figure 3:
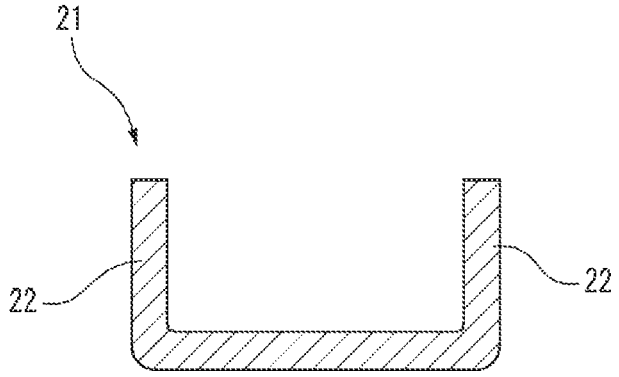
FIG. 3 is a cross sectional view of a terminal connection portion of the terminal fitting according to the first embodiment.

FIGS. 2A and 2B are views for explaining the connection structure of the terminal fitting according to the first embodiment. FIG. 2A is a perspective view of the terminal fitting 10 and a connection terminal 30, and FIG. 2B is a plan view of the terminal fitting 10 and the connection terminal 30.

As shown in FIGS. 2A and 2B, the terminal fitting 10 has a terminal body 11 and a plurality of terminal connection portions 21. The terminal fitting 10 is a press-formed article formed out of a conductive metal plate. The terminal body 11 includes a fixed plate portion 12 having a circular shape in planar view. In the fixed plate portion 12, a circular mounting hole 13 is formed at the center thereof. The terminal body 11 is fixed to the grounding surface of the body or the like of the vehicle by a bolt (not shown) inserted into the mounting hole 13 of the fixed plate portion 12. Incidentally, the mounting hole 13 may be provided eccentrically rather than at the center of the fixed plate portion 12.

In the fixed plate portion 12, a connection plate portion 14 is formed in an approximately half circumferential part of the circumferential edge thereof. The connection plate portion 14 projects on the side of the upper surface which is a one-side surface. Thus, a step is formed between the fixed plate portion 12 and the connection plate portion 14. In addition, a rotation stopper piece 15 is formed in a circumferentially central position of the other part of the fixed plate portion 12 than the connection plate portion 14. The rotation stopper piece 15 is a bent portion to be engaged with a step or a hole portion around the grounding surface to which the terminal body 11 is fastened by a bolt. When the rotation stopper piece 15 is engaged with the step or the hole portion around the grounding surface, the rotation stopper piece 15 regulates rotation of the terminal fitting 10 relative to the grounding surface.

Each terminal connection portion 21 is formed integrally with the connection plate portion 14 of the terminal body 11. A plurality of terminal connection portions 21 are provided in the connection plate portion 14. Specifically, three terminal connection portions 21 are formed in the connection plate portion 14. The terminal connection portions 21 is extended, within one and the same plane, from the circumferential edge of the fixed plate portion 12 in directions in which the grounding electric wires D connected to the connection terminals 30 are extracted respectively. The terminal connection portions 21 are disposed at widthwise intervals from one another. Incidentally, the center-side terminal connection portion 21 projects more in the extending direction than any other terminal connection portion 21 on either side thereof.

Each terminal connection portion 21 has engagement walls 22 in its opposite side portions. The engagement walls 22 serve as fastened caulking pieces that project on the side of the upper surface which is a one-side surface. Thus, each terminal connection portion 21 is formed into a U-shape in front view. Incidentally, adjacent ones of the engagement walls 22 of the terminal connection portions 21 are formed continuously to a circumferential wall portion 23 formed on the fixed plate portion 12 side.

Further, a concave engagement portion 53 is formed in a tip protruding portion of each terminal connection portion 21. The concave engagement portion 53 is provided in an opposed surface to abut against the connection terminal 30. The concave engagement portion 53 is a circular through hole, which forms a concave-convex engagement portion (engagement mechanism) 51 together with a convex engagement portion 55 provided in an opposed surface to abut against the terminal connection portion 21 in the connection terminal 30. The convex engagement portion 55 which will be described later.

Figure 4:
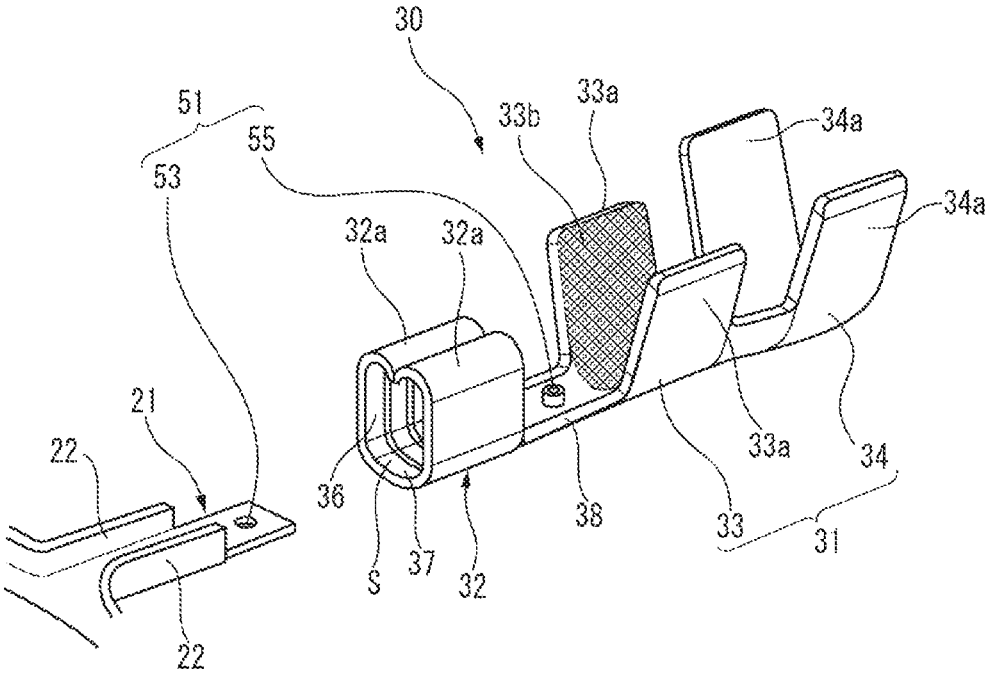
FIG. 4 is a perspective view of the terminal connection portion and the connection terminal.
Figure 5:
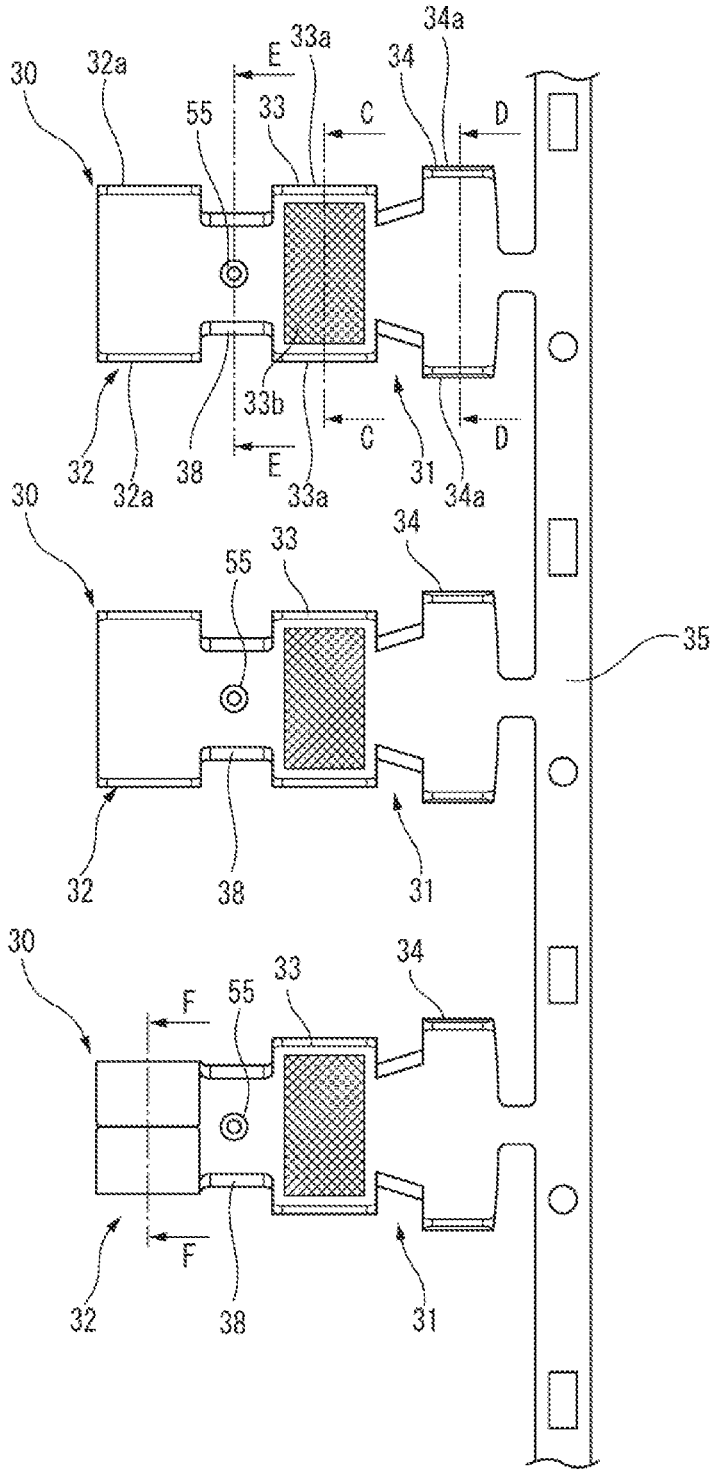
FIG. 5 is a plan view of connection terminals coupled with a carrier.
Figure 6A:
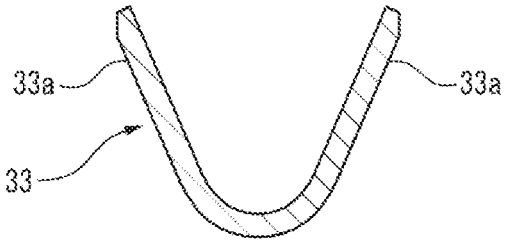
FIGS. 6A to 6D are views for explaining a connection terminal.
Figure 6B:
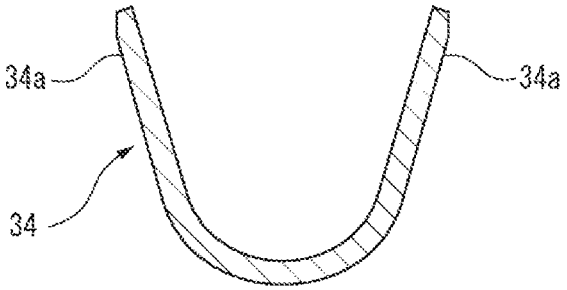
Figure 6C:
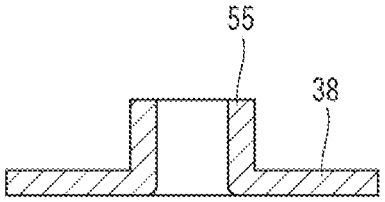
Figure 6D:
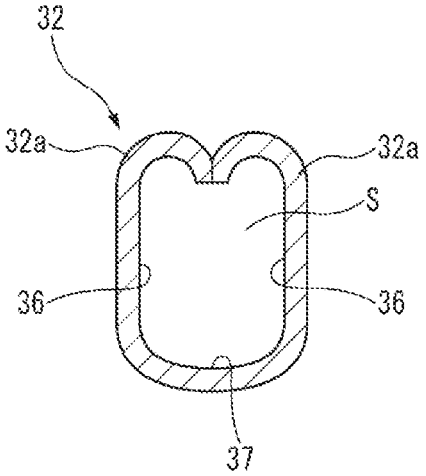

FIG. 4 is a perspective view of a terminal connection portion 21 and a connection terminal 30. FIG. 5 is a plan view of connection terminals 30 coupled with a carrier. FIGS. 6A to 6D are views for explaining a connection terminal 30. FIG. 6A is a sectional view taken on line C-C in FIG. 5. FIG. 6B is a sectional view taken on line D-D in FIG. 5. FIG. 6C is a sectional view taken on line E-E in FIG. 5. FIG. 6D is a sectional view taken on line F-F in FIG. 5.

As shown in FIG. 4, each connection terminal 30 has an electric wire connection portion 31 and a fastening connection portion 32. A grounding electric wire D is connected to the electric wire connection portion 31. The connection terminal 30 provided in the grounding electric wire D is a press-formed article formed out of a conductive metal plate. The fastening connection portion 32 is caulked and fastened to one of the terminal connection portions 21 of the terminal fitting 10.

As shown in FIG. 5, the connection terminals 30 are supplied in the state where the connection terminals 30 have been coupled with a belt-like carrier 35 on their electric wire connection portion 31 side. To use each connection terminal 30, the connection terminal 30 is separated from the carrier 35. Each electric wire connection portion 31 has a conductor caulking portion 33 and a coating caulking portion 34.

As shown in FIG. 4 and FIG. 6A, the conductor caulking portion 33 is formed into a U-shape including a pair of conductor caulking pieces 33*a*. When the conductor caulking pieces 33*a* are caulked, the conductor portion 1 of the grounding electric wire D is caulked and fixed to the conductor caulking portion 33. Thus, the conductor portion 1 of the grounding electric wire D is conductively connected to the connection terminal 30. In addition, a rough surface portion (serration) 33*b* that has been roughened by machining is provided in the inner surface of the conductor caulking portion 33. Incidentally, the rough surface portion 33*b* is not limited to the illustrated shape. Thus, the conductor portion 1 of the grounding electric wire D caulked to the conductor caulking portion 33 can be conductively connected to the connection terminal 30 surely.

As shown in FIG. 4 and FIG. 6B, the coating caulking portion 34 is formed into a U-shape including a pair of coating caulking pieces 34*a*. When the coating caulking pieces 34*a* are caulked, a tip part of the jacket 2 of the grounding electric wire D is caulked and fixed to the coating caulking portion 34.

In order to connect the grounding electric wire D to the connection terminal 30, the jacket 2 is removed to expose the conductor portion 1 in an end portion of the grounding electric wire D. Then, the end portion of the grounding electric wire D is disposed on the electric wire connection portion 31 of the connection terminal 30, and the conductor caulking portion 33 is caulked while the coating caulking portion 34 is caulked. After that, the connection terminal 30 is separated from the carrier 35. Thus, the grounding electric wire D is conductively connected to the connection terminal 30.

As shown in FIG. 4 and FIG. 6C, the fastening connection portion 32 of the connection terminal 30 has a pair of fastening caulking pieces 32*a*. Each fastening caulking piece 32*a* is provided erectly upward from a bottom portion of the fastening connection portion 32. In addition, the upper end portion of the fastening caulking piece 32*a* is bent and folded inward in an arc shape.

Thus, a retention space S surrounded by the fastening caulking pieces 32*a* is formed in the fastening connection portion 32 of the connection terminal 30. The opposite side faces of the retention space S are formed into substantially vertical faces due to the fastening caulking pieces 32*a* provided erectly upward. The opposite side faces serve as rotation regulation faces 36.

The retention space S of the fastening connection portion 32 is formed to be a little larger than the outer shape of the terminal connection portion 21 in front view. Thus, the terminal connection portion 21 can be inserted into the retention space S (see FIG. 8A). The terminal connection portion 21 inserted into the retention space S abuts against the rotation regulation faces 36 constituted by the opposite side faces forming the retention space S. In this manner, the terminal connection portion 21 can be regulated from rotating around an axis extending in the direction in which the terminal connection portion 21 has been inserted into the retention space S.

Further, as shown in FIG. 4 and FIG. 6D, in a coupling portion 38 between the electric wire connection portion 31 of the connection terminal 30 and the fastening connection portion 32, a convex engagement portion 55 is provided in an opposed face abutting against the terminal connection portion 21. The convex engagement portion 55 is a cylindrical protrusion provided erectly from the coupling portion 38. The convex engagement portion 55 is inserted into the concave engagement portion 53 of the terminal connection portion 21. The convex engagement portion 55 of the connection terminal 30 forms the concave-convex engagement portion 51 together with the concave engagement portion 53 of the terminal connection portion 21. In the state where the convex engagement portion 55 has been inserted into the concave engagement portion 53, the connection terminal 30 is regulated from moving in the direction in which the terminal connection portion 21 has been inserted into the retention space S of the connection terminal 30.

Next, description will be made about a case where the connection terminal 30 is caulked and fastened to the terminal connection portion 21 of the terminal fitting 10.

Figure 7:
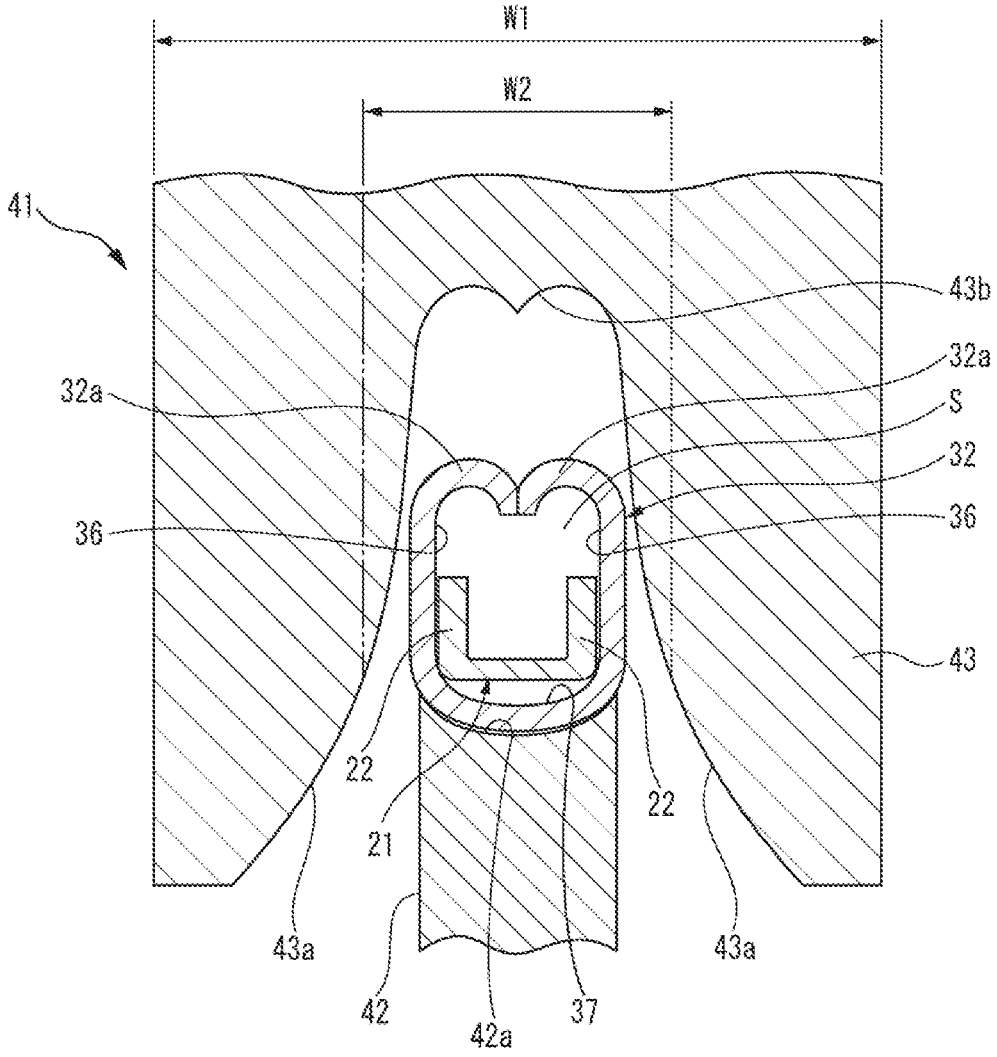
FIG. 7 is a schematic sectional view of a crimping machine in which a connection terminal and a terminal connection portion have been set.
Figure 8A:
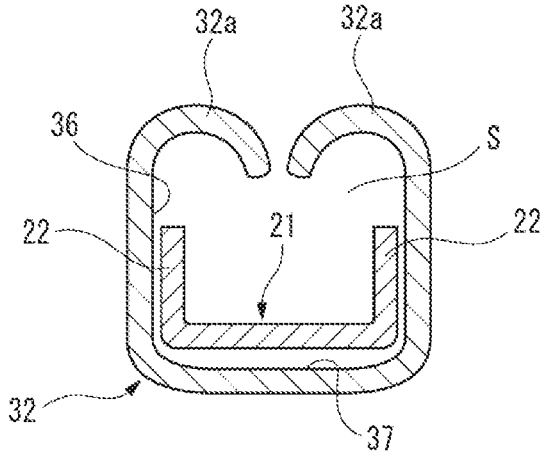
FIGS. 8A to 8D are views each showing a fastening state of fastening caulking pieces of a fastening connection portion to a terminal connection portion of the terminal fitting.
Figure 8B:
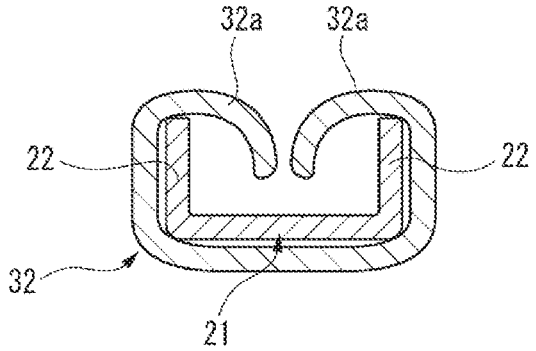
Figure 8C:
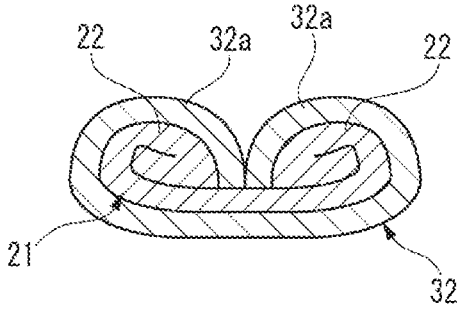

FIG. 7 is a schematic sectional view of a crimping machine 41 in which the connection terminal 30 and the terminal connection portion 21 have been set. FIGS. 8A to 8D are views each showing a fastening state of the fastening caulking pieces 32*a* of the fastening connection portion 32 to the terminal connection portion 21 of the terminal fitting 10. FIG. 8A is a sectional view taken on line A-A in FIG. 1B, showing a state where the fastening caulking pieces 32*a* have not been fastened yet. FIG. 8B is a sectional view taken on line A-A in FIG. 1B, showing a state where the fastening caulking pieces 32*a* are being fastened. FIG. 8C is a sectional view taken on line A-A in FIG. 1B, showing a state where the fastening caulking pieces 32*a* have been fastened.

As shown in FIG. 7, the crimping machine 41 for crimping the connection terminal 30 on the terminal connection portion 21 to thereby caulk and fasten the connection terminal 30 thereto includes an anvil 42, and a crimper 43 that can approach and leave the anvil 42. The top surface of the anvil 42 serves as a mounting face 42*a*. The connection terminal 30 is mounted on the mounting face 42*a*. The mounting face 42*a* is formed into a shape that is recessed slightly downward like an arc. Thus, the connection terminal 30 mounted on the mounting face 42*a* is disposed on the anvil 42. The crimper 43 is formed into a concave shape including a guide face 43*a* spreading gently toward the anvil 42. The crimper 43 has pressing faces 43*b* in an upper portion of its concave part. The pressing faces 43*b* press the fastening caulking pieces 32*a* while guiding the fastening caulking pieces 32*a* toward the inside respectively.

(Temporarily Fixing Step)

As shown in FIG. 8A, first, the connection terminal 30 and the terminal connection portion 21 are temporarily fixed to each other. Specifically, the terminal connection portion 21 is inserted into the retention space S of the connection terminal 30, and the concave engagement portion 53 of the tip protruding portion of the terminal connection portion 21 is fitted to the convex engagement portion 55 of the connection terminal 30. When the terminal connection portion 21 is thus inserted into the retention space S, the opposite side portions of the terminal connection portion 21 abut against the rotation regulation faces 36 constituted by the opposite side faces of the retention space S. Thus, the terminal connection portion 21 is retained by the fastening connection portion 32 of the connection terminal 30 in the state where the terminal connection portion 21 is regulated from rotating around the axis extending in the insertion direction. In addition, when the convex engagement portion 55 is inserted into the concave engagement portion 53 to thereby establish engagement in the concave-convex engagement portion 51, the terminal connection portion 21 is regulated from moving in the insertion direction to the retention space S of the connection terminal 30. Thus, the terminal connection portion 21 is kept in a predetermined posture and a predetermined position with respect to the connection terminal 30.

(Mounting Step)

As shown in FIG. 7, the connection terminal 30 temporarily fixing the terminal connection portion 21 is mounted on the mounting face 42*a* of the anvil 42 of the crimping machine 41. In this state, the terminal connection portion 21 is still inserted into the retention space S while engagement is established in the concave-convex engagement portion 51. Therefore, the terminal connection portion 21 is regulated from rotating around the axis extending in the insertion direction and moving in the insertion direction, so that the terminal connection portion 21 can be kept in the predetermined posture and the predetermined position with respect to the connection terminal 30.

(Fastening Step)

The crimping machine 41 is actuated to start crimping and move down the crimper 43 of the crimping machine 41. Thus, the fastening connection portion 32 is guided into the concave part by the guide faces 43*a* of the crimper 43. Still on this occasion, the terminal connection portion 21 is kept in the predetermined posture and the predetermined position inside the retention space S with respect to the connection terminal 30. After that, the pressing faces 43*b* of the crimper 43 abut against the upper portions of the fastening caulking pieces 32*a* of the fastening connection portion 32. As a result, the fastening caulking pieces 32*a* are crushed to start caulking.

Then, as shown in FIG. 8B, the fastening caulking pieces 32*a* roll up the opposite side portions of the terminal connection portion 21. After that, the fastening caulking pieces 32*a* are caulked to roll up the engagement walls 22 of the terminal connection portion 21 from outside.

Thus, as shown in FIG. 8C, the engagement walls 22 are rounded inside the fastening caulking pieces 32*a* and received therein tightly so that the fastening connection portion 32 can be filled with the terminal connection portion 21. Accordingly, the fastening connection portion 32 is caulked and fastened to the terminal connection portion 21 firmly with high contact pressure, while the terminal fitting 10 and the connection terminal 30 are conductively connected surely.

Further, due to the concave-convex engagement portion 51 provided in the opposed faces where the terminal connection portion 21 and the connection terminal 30 abut against each other, the terminal connection portion 21 is prevented from detaching from the fastening caulking pieces 32*a*. That is, when the fastening connection portion 32 is caulked and fastened to the terminal connection portion 21, the terminal connection portion 21 is made unable to leave the opposed surface in the bottom portion of the connection terminal 30 so that the terminal connection portion 21 cannot detach the concave engagement portion 53 from the convex engagement portion 55.

Figure 8D:
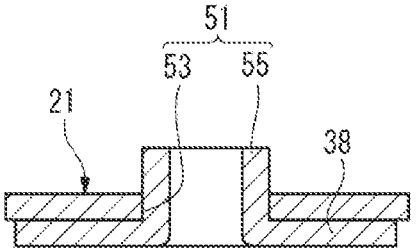

Thus, as shown in FIG. 8D, the concave-convex engagement portion 51 fitted in a direction (plate thickness direction of the coupling portion 38) perpendicular to the insertion direction of the terminal connection portion 21 to the coupling portion 38 can firmly prevent the terminal connection portion 21 from detaching from the fastening caulking pieces 32*a*.

Incidentally, of the convex engagement portion 55, the tip portion put through the concave engagement portion 53 may be caulked to the opening edge thereof so that the tip portion of the convex engagement portion 55 can be locked to the opening edge in the state where the tip portion of the convex engagement portion 55 has been curled all over the circumference of the concave engagement portion 53.

When the terminal connection portions 21 of the terminal fitting 10 and the connection terminals 30 are fastened and connected in the aforementioned steps, the grounding electric wires D are conductively connected to the terminal fitting 10 in a lump. When the terminal fitting 10 is fixed to the grounding surface of the vehicle by a bolt, the grounding electric wires D are grounded.

As has been described above, according to the connection structure of the terminal fitting according to the first embodiment, the terminal connection portion 21 is inserted into the retention space S surrounded by the fastening caulking pieces 32*a* of the connection terminal 30 so that the terminal connection portion 21 can be retained by the connection terminal 30. Thus, the fastening caulking pieces 32*a* can be caulked and fastened in the state where the terminal connection terminal 21 has been retained by the connection terminal 30. As a result, the terminal connection portion 21 can be kept in a stable posture when it is being fastened. Thus, a variation in crimping strength can be suppressed to obtain high reliability in connection.

In addition, according to the connection structure of the terminal fitting according to the first embodiment, the terminal connection portion 21 is inserted into and retained by the retention space S formed in advance in the connection terminal 30, and the fastening caulking pieces 32*a* are crushed and fastened to caulk and roll up the outer sides of the opposite side portions of the terminal connection portion 21 inside the retention space S. Thus, the fastening work can be performed in the state where the posture of the terminal connection portion 21 has been stabilized with respect to the connection terminal 30. In this manner, the workability can be improved, and a variation in crimping strength can be suppressed to obtain high reliability in connection. In addition, due to the retention space S formed in advance in the connection terminal 30, the width size can be suppressed in comparison with a case where the fastening caulking pieces 32*a* are formed into a U-shape widened upward. Thus, components including the crimper 43 can be miniaturized to save the working space during fastening by the crimping machine 41. For example, as shown in FIG. 7, in comparison with the case where fastening caulking pieces formed into a U-shape widened upward are caulked, the guide faces 43*a* can be made so small that the width size of the crimper 43 can be set at W2, which is much smaller than W1.

In addition, the terminal connection portion 21 inserted into the retention space S is retained by the connection terminal 30 in the state where the terminal connection portion 21 is regulated from rotating around the axis extending in the insertion direction by the rotation regulation faces 36 constituted by the opposite side faces of the retention space S. Thus, the terminal connection portion 21 can be kept in a more stable posture with respect to the connection terminal 30, so that the accuracy of caulking and fastening can be enhanced.

In addition, according to the first embodiment, when a plurality of grounding electric wires D are connected to the terminal fitting 10, the grounding electric wires D can be conductively connected to the terminal fitting 10 in a lump. It is therefore unnecessary to stack terminal fittings 10. Accordingly, in comparison with a background-art structure in which terminal fittings connected to grounding electric wires respectively are stacked and fastened for conductive connection, increase in weight of the terminal fitting 10 can be suppressed even when the number of grounding electric wires D increases. In addition, since it is not necessary to stack terminal fittings 10, the thickness of the terminal fitting 10 does not increase even when the number of electric wires D to be conductively connected increases. Thus, space saving can be attained. In addition, since the connection terminals 30 are fastened to the terminal connection portions 21 of the terminal fitting 10, it is possible to dispense with a special holding mechanism for holding the connection terminals 30. Thus, reduction in size and cost can be attained in comparison with a joint connector in which a holding mechanism for holding terminals has to be provided in a housing.

In addition, due to the structure in which separate connection terminals 30 are fastened and connected to the terminal fitting 10, the connection terminals 30 to which grounding electric wires D different in size have been connected can be fastened and conductively connected to the terminal connection portions 21. That is, grounding electric wires D having various sizes can be dealt with without changing the connection forms between the terminal connection portions 21 of the terminal fitting 10 and the fastening connection portions 32 of the connection terminals 30. In addition, when terminal fittings 10 differing in number of terminal connection portions 21 are prepared, it is possible to easily deal with increase or decrease in number of grounding electric wires D to be conductively connected.

Here, for example, a plurality of grounding electric wires D can be conductively connected in a lump in a terminal fitting in which a plurality of connection portions to which the grounding electric wires D can be connected are formed integrally. However, such a terminal fitting has to be prepared in accordance with the number of grounding electric wires D to be connected. In addition, a terminal fitting having connection portions corresponding to the grounding electric wires D has to be prepared in accordance with a change in size of the grounding electric wires D.

On the other hand, according to the connection structure of the terminal fitting according to the first embodiment, a change in number or size of grounding electric wires D to be conductively connected can be dealt with by a required minimum variation of terminal fittings 10.

In addition, due to the structure in which connection terminals 30 are caulked and fastened to a plurality of terminal connection portions 21 of the terminal fitting 10, the connection terminals 30 can be fastened to the terminal connection portions 21 in accordance with necessity. Thus, the number of grounding electric wires D to be conductively connected in a lump can be increased or decreased easily within the range of the number of terminal connection portions 21.

In addition, the engagement walls 22 that can be engaged with the fastening caulking pieces 32*a* are formed in the opposite side portions of the terminal connection portion 21. Accordingly, when the fastening caulking pieces 32*a* of the connection terminal 30 are caulked to the terminal connection portion 21, the fastening caulking pieces 32*a* are engaged with the engagement walls 22 of the terminal connection portion 21. Thus, the fastening caulking pieces 32*a* are surely crimped on the terminal connection portion 21 so that the connection strength of the connection terminal 30 to the terminal connection portion 21 can be further enhanced. It is therefore possible to stabilize electric resistance at the connection place to thereby improve the electric connection.

Further, due to the concave-convex engagement portion 51 provided as an engagement mechanism in the opposed surfaces where the terminal connection portion 21 and the connection terminal 30 abut against each other, the terminal connection portion 21 can be surely prevented from detaching from the fastening caulking pieces 32*a*. Thus, reliability in mechanical connection is improved in comparison with a structure in which connection is established only by caulking and fastening of the fastening connection portion 32. In addition, the concave-convex engagement portion 51 according to the first embodiment can be formed easily in the terminal connection portion 21 and the connection terminal 30 by press working. Thus, increase in working cost can be suppressed.

In addition, within one and the same plane, the terminal connection portions 21 are disposed at intervals from one another and extended in directions in which the grounding electric wires D connected to the connection terminals 30 are extracted respectively. Accordingly, the connection direction of each connection terminal 30 to the terminal fitting 10 and the wiring direction of a corresponding one of the grounding electric wires D can be aligned in one and the same direction, so that the workability in fastening the connection terminal 30 to the terminal connection portion 21 of the terminal fitting 10 can be improved. In addition, the wiring directions of the grounding electric wires D are aligned in one and the same direction so that they can be disposed along a flow of a trunk line. Further, useless spreading of the grounding electric wires D or bending of the grounding electric wires D near the connection terminals 30 can be suppressed as well as possible.

Incidentally, in the aforementioned first embodiment, the engagement walls 22 are provided in the opposite side portions as the terminal connection portion 21 so that the terminal connection portion 21 can be formed into a U-shape in sectional view. However, the sectional shape of the terminal connection portion 21 is not limited to the aforementioned shape. For example, engagement pieces bent inward and folded like an arc may be formed in the upper end portions of the engagement walls 22, and the sectional shape of the terminal connection portion 21 may be formed into a V-shape.

In addition, the first embodiment has been described along an example in which the terminal fitting 10 including three terminal connection portions 21 is used. However, the number of terminal connection portions 21 in the terminal fitting 10 is not limited to three, but it may be four or more as long as it is plural.

Further, in the first embodiment, the concave-convex engagement portion 51 is constituted by the concave engagement portion 53 that is a circular through hole formed in the tip protruding portion of the terminal connection portion 21, and the convex engagement portion 55 that is a cylindrical protrusion provided erectly from the coupling portion 38. However, the invention is not limited thereto. A concave-convex engagement portion may be constituted by a convex engagement portion that is a cylindrical protrusion protruding downward from the tip protruding portion of the terminal connection portion 21, and a concave engagement portion that is a circular through hole formed in the coupling portion 38.

That is, as the concave-convex engagement portion provided in the opposed surfaces where the terminal connection portion 21 and the connection terminal 30 abut against each other respectively, various forms may be taken as long as the terminal connection portion 21 can be regulated from moving in the insertion direction to the connection terminal 30. For example, a concave-convex engagement portion may be constituted by a recess (concave engagement portion) that is formed in one of the opposed surfaces, and an engagement protruding portion (convex engagement portion) that protrudes from the other opposed surface so as to be engaged with the recess.

Second Embodiment

Next, description will be made about a connection structure for a terminal fitting according to a second embodiment of the invention.

Figure 9A:
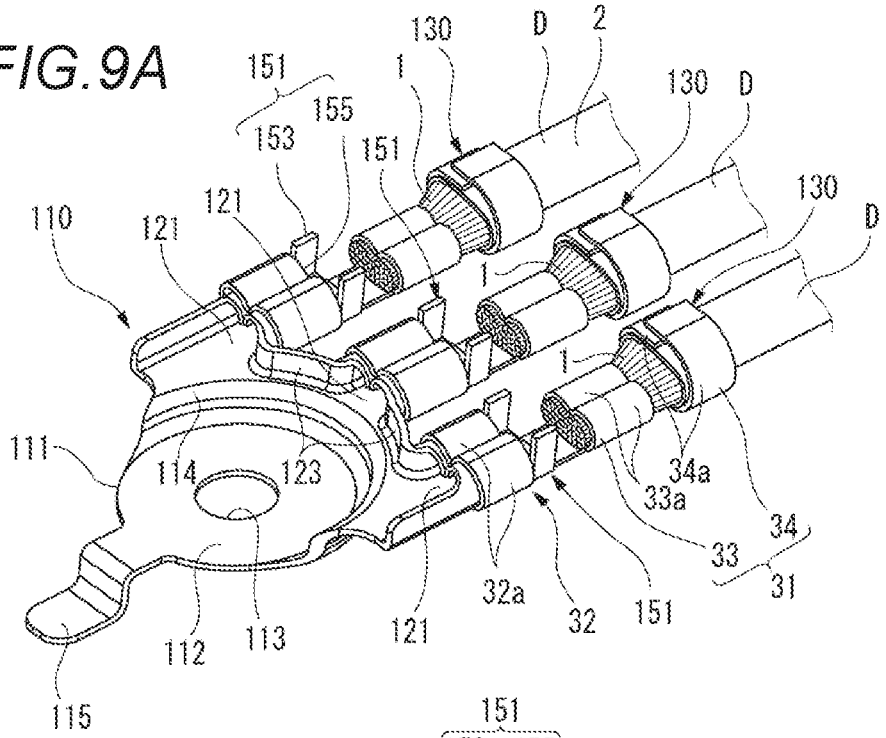
FIGS. 9A and 9B are views for explaining a connection structure for a terminal fitting according to a second embodiment of the invention.
Figure 9B:
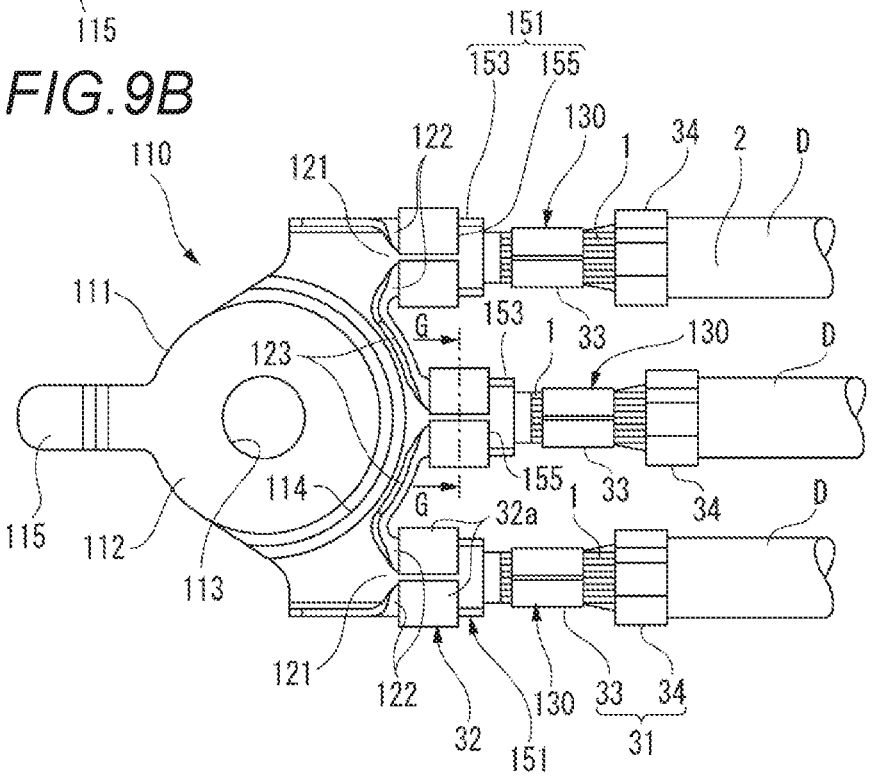
Figure 10A:
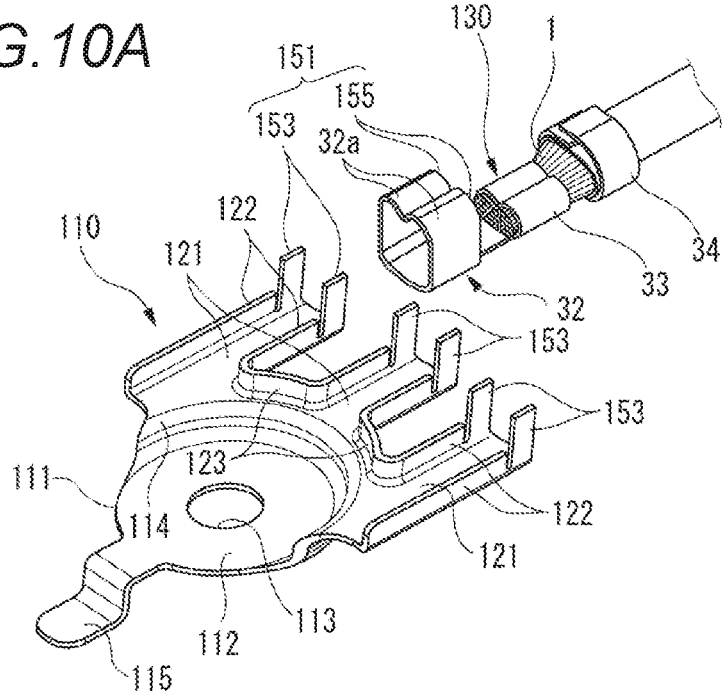
FIGS. 10A and 10B are views for explaining the connection structure of the terminal fitting according to the second embodiment.
Figure 10B:
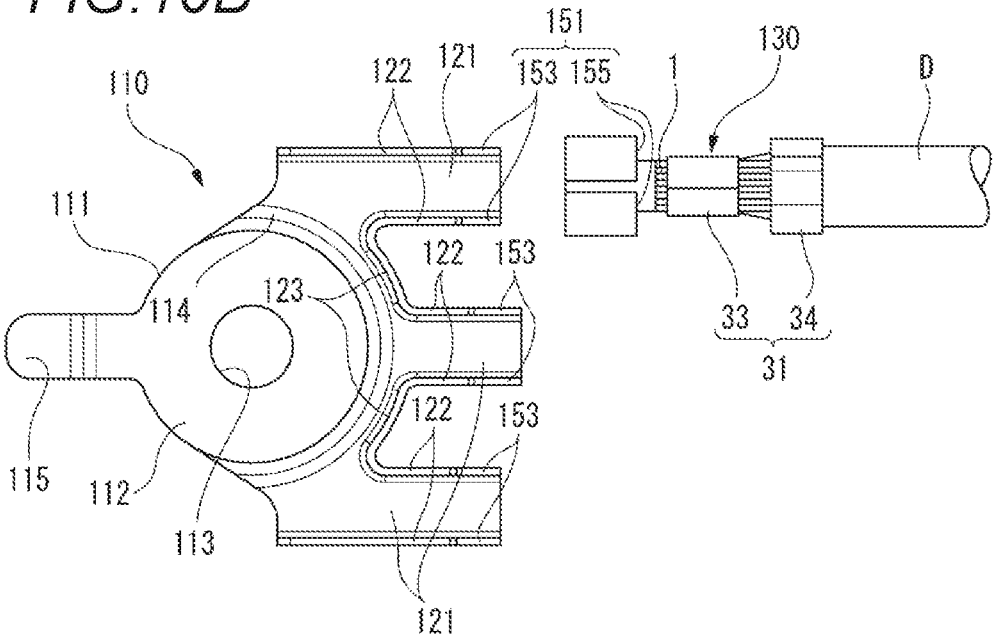

FIGS. 9A and 9B are views for explaining the connection structure of the terminal fitting according to the second embodiment. FIG. 9A is a perspective view of a terminal fitting 110 to which grounding electric wires D have been connected, and FIG. 9B is a plan view of the terminal fitting 110 to which the grounding electric wires D have been connected. FIGS. 10A and 10B are views for explaining the connection structure of the terminal fitting 110 according to the second embodiment. FIG. 10A is a perspective view of the terminal fitting 110 and a connection terminal 130, and FIG. 10B is a plan view of the terminal fitting 110 and the connection terminal 130.

As shown in FIGS. 9A and 9B and FIGS. 10A and 10B, the terminal fitting 110 is connected to connection terminals 130 in the connection structure of the terminal fitting according to the second embodiment. The terminal fitting 110 is also conductively connected to a grounding surface of a body or the like of a vehicle. Thus, the grounding electric wires D of on-vehicle circuits are conductively connected to the grounding surface of the body or the like of the vehicle through the terminal fitting 110.

Figure 11A:
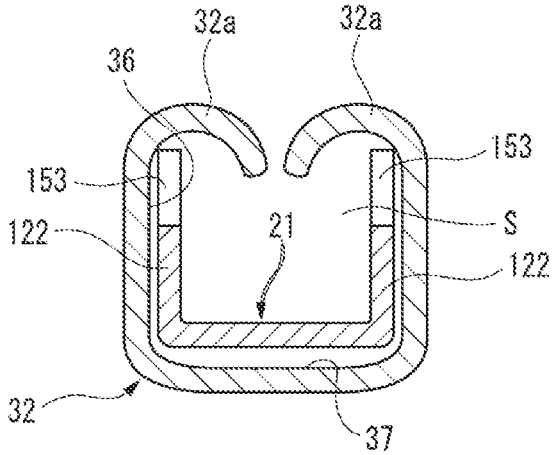
FIGS. 11A to 11C are views each showing a fastening state of fastening caulking pieces of a fastening connection portion to a terminal connection portion of the terminal fitting.
Figure 11B:
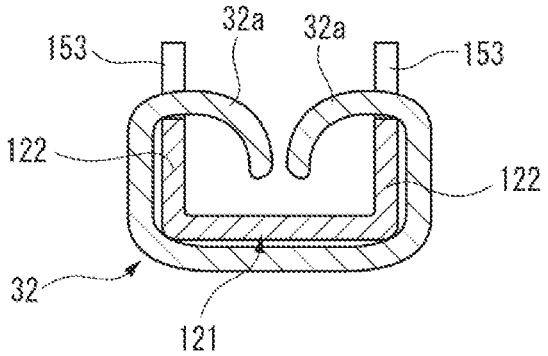
Figure 11C:
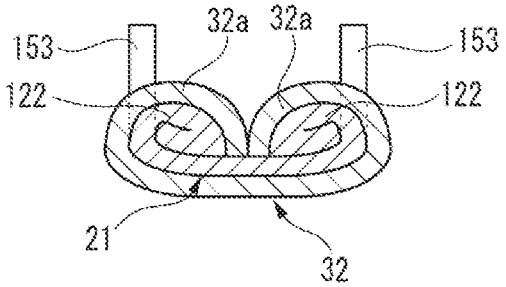

FIGS. 11A to 11C are views each showing a fastening state of fastening caulking pieces 32*a* of a fastening connection portion 32 to a terminal connection portion 121 of the terminal fitting 110. FIG. 11A is a sectional view taken on line G-G in FIG. 9B, showing a state where the fastening caulking pieces 32*a* have not been fastened yet. FIG. 11B is a sectional view taken on line G-G in FIG. 9B, showing a state where the fastening caulking pieces 32*a* are being fastened. FIG. 11C is a sectional view taken on line G-G in FIG. 9B, showing a state where the fastening caulking pieces 32*a* have been fastened.

As shown in FIGS. 10A and 10B, the terminal fitting 110 has a terminal body 111 and a plurality of terminal connection portions 121. The terminal fitting 110 is a press-formed article formed out of a conductive metal plate. The terminal body 111 includes a fixed plate portion 112 having a circular shape in planar view. In the fixed plate portion 112, a circular mounting hole 113 is formed at the center thereof. The terminal body 111 is fixed to the grounding surface of the body or the like of the vehicle by a bolt (not shown) inserted into the mounting hole 113 of the fixed plate portion 112. Incidentally, the mounting hole 113 may be provided eccentrically rather than at the center of the fixed plate portion 112.

In the fixed plate portion 112, a connection plate portion 114 is formed in an approximately half circumferential part of the circumferential edge thereof. The connection plate portion 114 projects on the side of the upper surface which is a one-side surface. Thus, a step is formed between the fixed plate portion 112 and the connection plate portion 114. In addition, a rotation stopper piece 115 is formed in a circumferentially central position of the other part of the fixed plate portion 112 than the connection plate portion 114. The rotation stopper piece 115 is a bent portion to be engaged with a step or a hole portion around the grounding surface to which the terminal body 111 is fastened by a bolt. When the rotation stopper piece 115 is engaged with the step or the hole portion around the grounding surface, the rotation stopper piece 115 regulates rotation of the terminal fitting 110 relative to the grounding surface.

Each terminal connection portion 121 is formed integrally with the connection plate portion 114 of the terminal body 111. A plurality of terminal connection portions 121 are provided in the connection plate portion 114. Specifically, three terminal connection portions 121 are formed in the connection plate portion 114. The terminal connection portions 121 is extended, within one and the same plane, from the circumferential edge of the fixed plate portion 112 in directions in which the grounding electric wires D connected to the connection terminals 130 are extracted respectively. The terminal connection portions 121 are disposed at widthwise intervals from one another. Incidentally, the center-side terminal connection portion 121 projects more in the extending direction than any other terminal connection portion 121 on either side thereof.

Each terminal connection portion 121 has engagement walls 122 in its opposite side portions. The engagement walls 122 serve as fastened caulking pieces that project on the side of the upper surface which is a one-side surface. Thus, each terminal connection portion 121 is formed into a U-shape in front view. Incidentally, adjacent ones of the engagement walls 122 of the terminal connection portions 121 are formed continuously to a circumferential wall portion 123 formed on the fixed plate portion 112 side.

Further, engagement protruding portions 153 are formed in tip portions of the engagement walls 122. The engagement protruding portions 153 are provided on the terminal connection portion 121 so as to abut against electric-wire-side side faces 155 of the fastening caulking pieces 32*a*. The engagement protruding portions 153 are a pair of protruding pieces in which the upper edges of the tip portions of the engagement walls 122 are extended to protrude upward. The engagement protruding portions 153 form an engagement mechanism 151 together with the electric-wire-side side faces 155 of the fastening caulking pieces 32*a* in the connection terminal 130.

First, in order to connect a grounding electric wire D to the aforementioned terminal fitting 110, a jacket 2 is removed to expose a conductor portion 1 in an end portion of the grounding electric wire D. Then, the end portion of the grounding electric wire D is disposed on an electric wire connection portion 31 of the connection terminal 130, and a conductor caulking portion 33 is caulked while a coating caulking portion 34 is caulked. Thus, the connection terminal 130 is connected to the grounding electric wire D.

Next, the terminal connection portion 121 of the terminal fitting 110 is inserted into a retention space S of a fastening connection portion 32 of the connection terminal 130 connected to the grounding electric wire D, while the engagement protruding portions 153 in the tip portions of the engagement walls 122 are put through the fastening connection portion 32 toward the grounding electric wire D so as to be temporarily fixed thereto. Then, the fastening caulking pieces 32*a* are caulked.

Here, as shown in FIG. 11A, the fastening caulking pieces 32*a* are caulked in the state where the terminal connection portion 121 of the terminal fitting 110 has been disposed in the retention space S of the fastening connection portion 32 of the connection terminal 130. At the start of the caulking, the fastening caulking pieces 32*a* roll up the opposite side portions of the terminal connection portion 121 of the terminal body 111 as shown in FIG. 11B.

After that, as shown in FIG. 11C, the fastening caulking pieces 32*a* are caulked to roll up the engagement walls 122 of the terminal connection portion 121 from outside. Thus, the engagement walls 122 are rounded inside the fastening caulking pieces 32*a* and received therein tightly so that the fastening connection portion 32 can be filled with the terminal connection portion 121. In addition, still on this occasion, the terminal connection portion 121 is kept in a predetermined posture inside the retention space S with respect to the connection terminal 30. Accordingly, the fastening connection portion 32 is caulked and fastened to the terminal connection portion 121 firmly with high contact pressure, while the terminal fitting 110 and the connection terminal 30 are crimped with good balance and conductively connected surely.

Further, due to the engagement protruding portions 153 formed in the tip portions of the engagement walls 122, the terminal connection portion 121 is prevented from detaching from the fastening caulking pieces 32*a*. That is, when the fastening connection portion 32 is caulked and fastened to the terminal connection portion 121, the engagement protruding portions 153 abut against the electric-wire-side side faces 155 of the fastening caulking pieces 32*a*.

Thus, as shown in FIGS. 9A and 9B, the engagement mechanism 151 in which the engagement protruding portions 153 abut against the electric-wire-side side faces of the fastening caulking pieces 32*a* can firmly prevent the terminal connection portion 121 from detaching from the fastening caulking pieces 32*a*.

Incidentally, of the pair of engagement protruding portions 153 that have been put through the retention space S of the fastening connection portion 32, the tip portions may be opened in the terminal width direction so that wide portions provided thus on the opposite side portions of the terminal connection portion 121 can be locked to the electric-wire-side side faces 155.

In the aforementioned manner, the connection terminals 130 are caulked and fastened to the terminal connection portions 121 of the terminal fitting 110 respectively. Thus, the grounding electric wires D are conductively connected to the terminal fitting 110 in a lump. When the terminal fitting 110 is fixed to the grounding surface of the vehicle by a bolt, the grounding electric wires D are grounded.

As has been described above, also according to the second embodiment, the terminal connection portion 121 is inserted into the retention space S surrounded by the fastening caulking pieces 32*a* of the connection terminal 130 so that the terminal connection portion 121 can be retained by the connection terminal 130. Thus, the fastening caulking pieces 32*a* can be caulked and fastened in the state where the terminal connection terminal 121 has been retained by the connection terminal 130. As a result, the terminal connection portion 121 can be kept in a stable posture when it is being caulked and fastened. Thus, a variation in crimping strength can be suppressed to obtain high reliability in connection.

In addition, the fastening work can be performed in the state where the posture of the terminal connection portion 121 has been stabilized with respect to the connection terminal 130. Thus, the workability can be improved, and a variation in crimping strength can be suppressed to obtain high reliability in connection. In addition, due to the retention space S formed in advance in the connection terminal 130, the width size can be suppressed in comparison with a case where the fastening caulking pieces 32*a* are formed into a U-shape widened upward. Thus, components including the crimper 43 can be miniaturized to save the working space during fastening by the crimping machine 41.

In addition, also in the connection structure of the terminal fitting according to the second embodiment, the connection terminals 130 connected to a plurality of grounding electric wires D are caulked and fastened to the terminal connection portions 121 of the terminal fitting 110, so that the grounding electric wires D can be conductively connected to the terminal fitting 110 in a lump surely and with high reliability in connection.

In addition, in the same manner as in the first embodiment, when the fastening caulking pieces 32*a* of the connection terminals 130 connected to a plurality of grounding electric wires D are caulked to the terminal connection portions 121 provided in the terminal fitting 110, the connection terminals 130 can be fastened to the terminal fitting 110 to thereby conductively connect the grounding electric wires D to the terminal fitting 110 in a lump. It is therefore unnecessary to stack terminal fittings 110. Accordingly, in comparison with a structure in which terminal fittings connected to electric wires respectively are stacked and fastened for conductive connection, increase in weight of the terminal fitting can be suppressed even when the number of grounding electric wires D increases. In addition, since it is not necessary to stack terminal fittings, the thickness of the terminal fitting does not increase even when electric wires to be conductively connected increases. Thus, space saving can be attained. In addition, since the connection terminals 130 are fastened to the terminal connection portions 121 of the terminal fitting 110, it is possible to dispense with a special holding mechanism for holding the connection terminals 130. Thus, reduction in size and cost can be attained in comparison with a joint connector in which a holding mechanism for holding terminals has to be provided in a housing.

In addition, due to the structure in which separate connection terminals 130 are fastened and connected to the terminal fitting 110, the connection terminals 130 to which grounding electric wires D different in size have been connected can be caulked and fastened to the terminal connection portions 121 to be thereby conductively connected thereto. That is, grounding electric wires D having various sizes can be dealt with without changing the connection forms between the terminal connection portions 121 of the terminal fitting 110 and the fastening connection portions 32 of the connection terminals 130. In addition, when terminal fittings 110 differing in number of terminal connection portions 121 are prepared, it is possible to easily deal with increase or decrease in number of grounding electric wires D to be conductively connected.

That is, also in the connection structure of the terminal fitting according to the second embodiment, a change in number or size of grounding electric wires D to be conductively connected can be dealt with by a required minimum variation of terminal fittings 110.

In addition, due to the structure in which connection terminals 130 are caulked and fastened to a plurality of terminal connection portions 121 of the terminal fitting 110, the connection terminals 130 can be caulked and fastened to the terminal connection portions 121 in accordance with necessity. Thus, the number of grounding electric wires D to be conductively connected in a lump can be increased or decreased easily within the range of the number of terminal connection portions 121.

In addition, the engagement walls 122 that can be engaged with the fastening caulking pieces 32*a* are formed in the opposite side portions of the terminal connection portion 121. Accordingly, when the fastening caulking pieces 32*a* of the connection terminal 130 are caulked to the terminal connection portion 121, the fastening caulking pieces 32*a* are engaged with the engagement walls 122 of the terminal connection portion 121. Thus, the fastening caulking pieces 32*a* are surely crimped on the terminal connection portion 121 so that the connection strength of the connection terminal 130 to the terminal connection portion 121 can be further enhanced. It is therefore possible to stabilize electric resistance at the connection place to thereby improve the electric connection.

Further, since the engagement mechanism 151 for preventing the terminal connection portion 121 from detaching from the fastening caulking pieces 32*a* is provided between the terminal connection portion 121 and the connection terminal 130, the terminal connection portion 121 can be prevented from detaching from the fastening caulking pieces 32*a* when the engagement protruding portions 153 of the terminal connection portion 121 abut against the electric-wire-side side faces 155 of the fastening caulking pieces 32*a*. That is, the engagement mechanism 151 can be formed only if the engagement protruding portions 153 are provided in the tip portions of the engagement walls 122 in the terminal connection portion 121. Thus, increase in working cost can be suppressed.

In addition, within one and the same plane, the terminal connection portions 121 are disposed at intervals from one another and extended in directions in which the grounding electric wires D connected to the connection terminals 130 are extracted respectively. Accordingly, the connection direction of each connection terminal 130 to the terminal fitting 110 and the wiring direction of a corresponding one of the grounding electric wires D can be aligned in one and the same direction, so that the workability in fastening the connection terminal 130 to the terminal connection portion 121 of the terminal fitting 110 can be improved. In addition, the wiring directions of the grounding electric wires D are aligned in one and the same direction so that they can be disposed along a flow of a trunk line. Further, useless spreading of the grounding electric wires D or bending of the grounding electric wires D near the connection terminals 130 can be suppressed as well as possible.

Incidentally, in the second embodiment, the upper edges in the tip portions of the engagement walls 122 are extended to protrude upward to thereby form a pair of protruding pieces, which serve as the engagement protruding portions 153 of the terminal connection portion 121 abutting against the electric-wire-side side faces 155 of the fastening caulking pieces 32*a*. However, the invention is not limited thereto.

That is, the engagement mechanism provided between the terminal connection portion 121 and the connection terminal 130 may take various forms as long as the terminal connection portion 121 can be regulated from moving in the insertion direction to the fastening connection portion 32. For example, the fastening connection portion may have a U-shape in section, in which the upper end portion of each fastening caulking piece is not bent inward and folded like an arc shape. In this case, the protruding tip portion of the terminal connection portion is formed into a T-shape. After the terminal connection portion is inserted from above the fastening connection portion, the fastening caulking pieces are caulked and fastened so that the T-shape part of the protruding tip portion can abut against the electric-wire-side side faces of the fastening caulking pieces. In this manner, the engagement mechanism may be formed.

Third Embodiment

Next, description will be made about a connection structure for a terminal fitting according to a third embodiment of the invention.

Figure 12A:
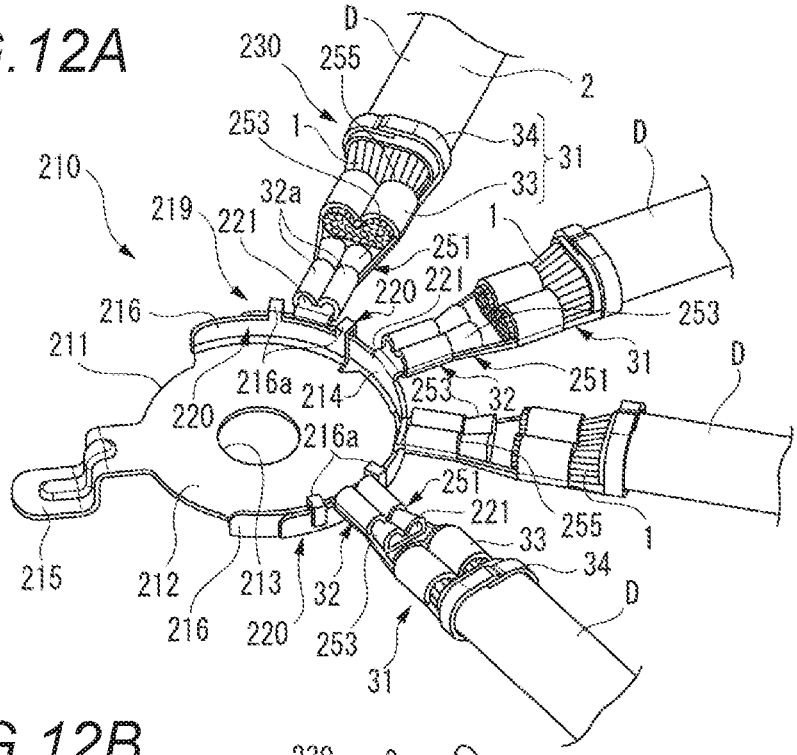
FIGS. 12A and 12B are views for explaining a connection structure for a terminal fitting according to a third embodiment of the invention.
Figure 12B:
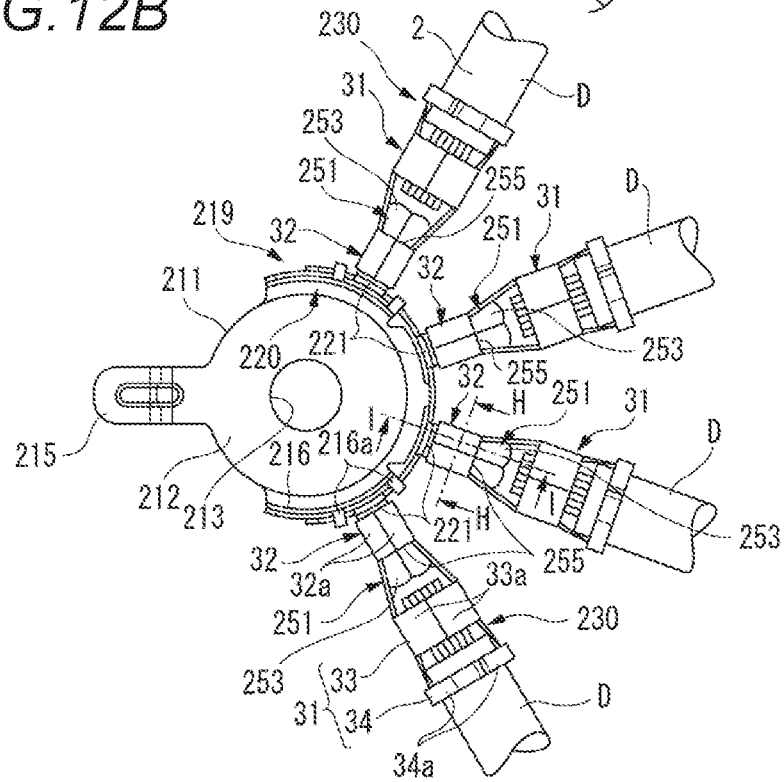
Figure 13:
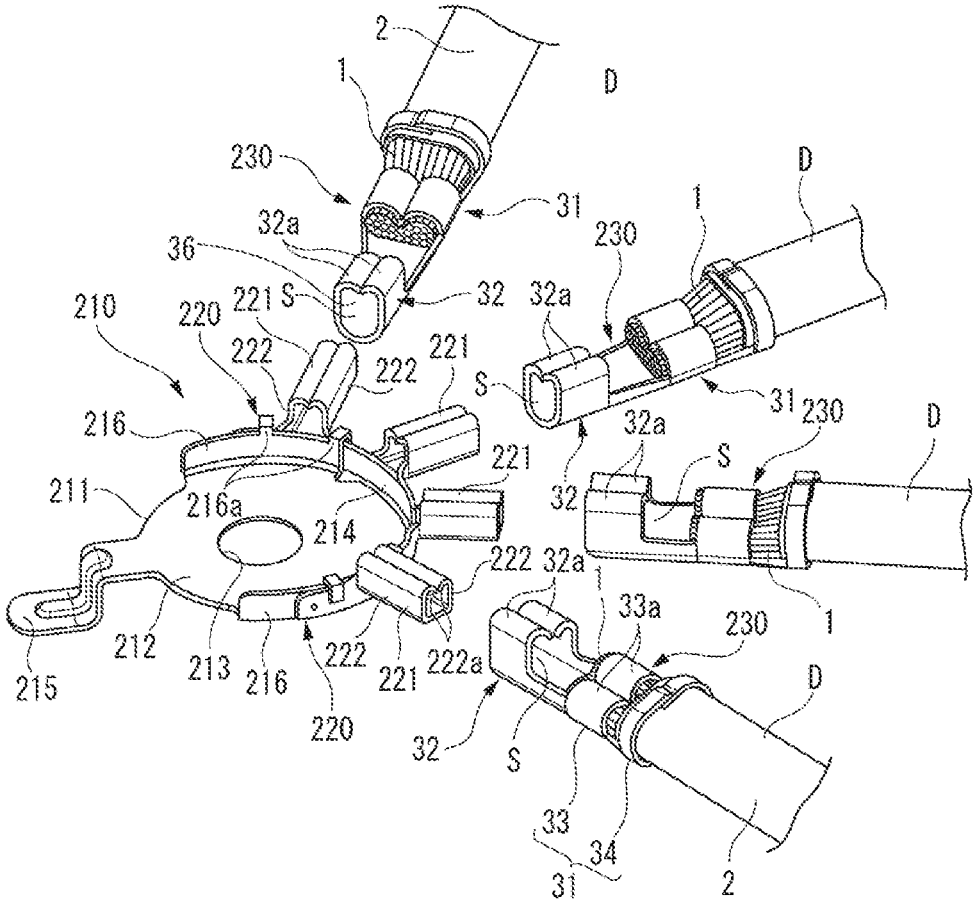
FIG. 13 is a perspective view of the terminal fitting and connection terminals, for explaining the connection structure of the terminal fitting according to the third embodiment.

FIGS. 12A and 12B are views for explaining the connection structure of the terminal fitting according to the third embodiment. FIG. 12A is a perspective view of a terminal fitting 210 to which grounding electric wires D have been connected, and FIG. 12B is a plan view of the terminal fitting 210 to which the grounding electric wires D have been connected. FIG. 13 is a perspective view of the terminal fitting 210 and connection terminals 230, for explaining the connection structure of the terminal fitting according to the third embodiment.

As shown in FIGS. 12A and 12B and FIG. 13, the terminal fitting 210 has a terminal body 211, and an electric wire connection portion body 219 including a plurality of terminal connection portions 221. The terminal fitting 210 is a press-formed article formed out of a conductive metal plate. The terminal body 211 includes a fixed plate portion 212 having a circular shape in planar view. In the fixed plate portion 212, a circular mounting hole 213 is formed at the center thereof. The terminal body 211 is fixed to a grounding surface of a body or the like of a vehicle by a bolt (not shown) inserted into the mounting hole 213 of the fixed plate portion 212. Incidentally, the mounting hole 213 may be provided eccentrically rather than at the center of the fixed plate portion 212.

A rotation stopper piece 215 is formed in a part of the fixed plate portion 212. The rotation stopper piece 215 is a bent portion to be engaged with a step or a hole portion around the grounding surface to which the terminal body 211 is fastened by a bolt. When the rotation stopper piece 215 is engaged with the step or the hole portion around the grounding surface, the rotation stopper piece 215 regulates rotation of the terminal fitting 210 relative to the grounding surface.

Two support wall portions 216 each having an arc shape in planar view are formed at the circumferential edge of the fixed plate portion 212. With respect to the fixed plate portion 212, the support wall portions 216 are provided erectly on the side of the upper surface which is a one-side surface. In addition, in the electric wire connection portion body 219, a connection plate portion 214 having an arc shape in planar view is formed in an approximately half circumferential part of the circumferential edge of the fixed plate portion 212. With respect to the fixed plate portion 212, the connection plate portion 214 is provided erectly on the side of the upper surface which is a one-side surface. The connection plate portion 214 is disposed along the outer circumferential surfaces of the support wall portions 216.

A plurality of lock pieces 216*a* are formed at the upper edge of each support wall portion 216. The lock pieces 216*a* are folded back toward the outer surface of the connection plate portion 214 so that the opposite ends of the connection plate portion 214 can be locked by the lock pieces 216*a*. Thus, the connection plate portion 214 is supported by the support wall portions 216.

In this manner, in the terminal fitting 210 according to the third embodiment, the parts where the connection plate portion 214 is locked by the lock pieces 216*a* of the support wall portions 216 serve as coupling portions 220. That is, the terminal fitting 210 includes a plurality of coupling portions 220 so that the terminal body 211 and the electric wire connection portion body 219 can be coupled with each other by the coupling portions 220.

Each terminal connection portion 221 is formed integrally with the connection plate portion 214 of the terminal body 211. A plurality of terminal connection portions 221 are provided in the connection plate portion 214. Specifically, three terminal connection portions 221 are formed in the connection plate portion 214. The terminal connection portions 221 are extended, within one and the same plane, from the circumferential edge of the fixed plate portion 212 so as to project radially.

Each terminal connection portion 221 has engagement walls 222 in its opposite side portions. The engagement walls 222 serve as fastened caulking pieces that project on the side of the upper surface which is a one-side surface. Thus, each terminal connection portion 221 is formed into a U-shape in front view. In addition, each engagement wall 222 has an engagement piece 222*a* in its upper end portion. The engagement piece 222*a* is bent inward and folded like an arc.

Further, the length of each engagement wall 222 of the terminal connection portion 221 in the terminal insertion direction is longer than a fastening connection portion 32 in a connection terminal 230, which will be described later.

Each connection terminal 230 has an electric wire connection portion 31 and a fastening connection portion 32. A grounding electric wire D is connected to the electric wire connection portion 31. The connection terminal 230 provided in the grounding electric wire D is a press-formed article formed out of a conductive metal plate. The fastening connection portion 32 is caulked and fastened to one of the terminal connection portions 221 of the terminal fitting 210.

As shown in FIG. 13, the fastening connection portion 32 of the connection terminal 230 has a pair of fastening caulking pieces 32*a*. Each fastening caulking piece 32*a* is provided erectly upward from a bottom portion of the fastening connection portion 32. In addition, the upper end portion of the fastening caulking piece 32*a* is bent and folded inward in an arc shape.

Thus, a retention space S surrounded by the fastening caulking pieces 32*a* is formed in the fastening connection portion 32 of the connection terminal 230. The opposite side faces of the retention space S are formed into substantially vertical faces due to the fastening caulking pieces 32*a* provided erectly upward. The opposite side faces serve as rotation regulation faces 36.

The retention space S of the fastening connection portion 32 is formed to be a little larger than the outer shape of the terminal connection portion 221 in front view. Thus, the terminal connection portion 221 can be inserted into the retention space S. The terminal connection portion 221 inserted into the retention space S abuts against the rotation regulation faces 36 constituted by the opposite side faces forming the retention space S. In this manner, the terminal connection portion 221 can be regulated from rotating around an axis extending in the direction in which the terminal connection portion 221 has been inserted into the retention space S.

In addition, the length of the fastening connection portion 32 in the terminal insertion direction is shorter than each engagement wall 222 of the terminal connection portion 221. A tip portion of the terminal connection portion 221 inserted into the retention space S of the fastening connection portion 32 is put through the fastening connection portion 32 and exposed on the grounding electric wire D side. The tip portion of the terminal connection portion 221 exposed on the grounding electric wire D side is not crushed but left after the fastening caulking pieces 32*a* are caulked. Accordingly, the tip portion of the terminal connection portion 221 serves as an enlarged diameter portion (non-caulked portion) in comparison with a caulked part of the terminal connection portion 221. The enlarged diameter portion serves as engagement protruding portions 253 that can abut against electric-wire-side side faces 255 of the fastening caulking pieces 32*a*.

First, in order to connect a grounding electric wire D to the connection terminal 230, a jacket 2 is removed to expose a conductor portion 1 in an end portion of the grounding electric wire D. Then, the end portion of the grounding electric wire D is disposed on the electric wire connection portion 31 of the connection terminal 230, and a conductor caulking portion 33 is caulked while a coating caulking portion 34 is caulked. Thus, the connection terminal 230 is connected to the grounding electric wire D.

Next, the terminal connection portion 221 of the terminal fitting 210 is inserted into the retention space S of the fastening connection portion 32 of the connection terminal 230 connected to the grounding electric wire D, while the tip portion of the terminal connection portion 221 is put through the fastening connection portion 32 toward the grounding electric wire D so as to be temporarily fixed thereto. Then, the fastening caulking pieces 32*a* are caulked.

Here, the fastening caulking pieces 32*a* are caulked in the state where the terminal connection portion 221 of the terminal fitting 210 has been disposed in the retention space S of the fastening connection portion 32 of the connection terminal 230. At the start of the caulking, the fastening caulking pieces 32*a* roll up the opposite side portions of the terminal connection portion 221 of the terminal body 211.

Figure 14A:
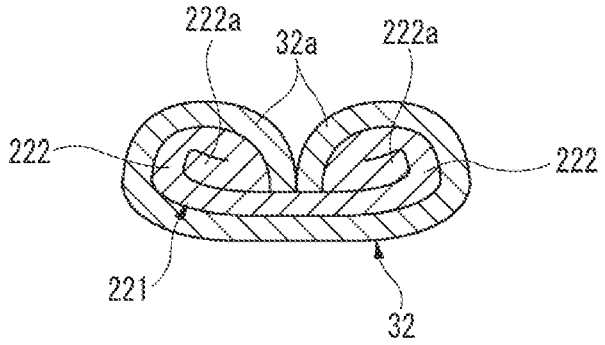
FIG. 14A is a sectional view taken on line H-H in FIG. 12B.

After that, as shown in FIG. 14A, the fastening caulking pieces 32*a* are caulked to roll up the engagement walls 222 of the terminal connection portion 221 from outside. Thus, the engagement walls 222 are rounded inside the fastening caulking pieces 32*a* and received therein tightly so that the fastening connection portion 32 can be filled with the terminal connection portion 221. In addition, still on this occasion, the terminal connection portion 221 is kept in a predetermined posture inside the retention space S with respect to the connection terminal 230. Accordingly, the fastening connection portion 32 is caulked and fastened to the terminal connection portion 221 firmly with high contact pressure, while the terminal fitting 210 and the connection terminal 230 are crimped with good balance and conductively connected surely.

Figure 14B:
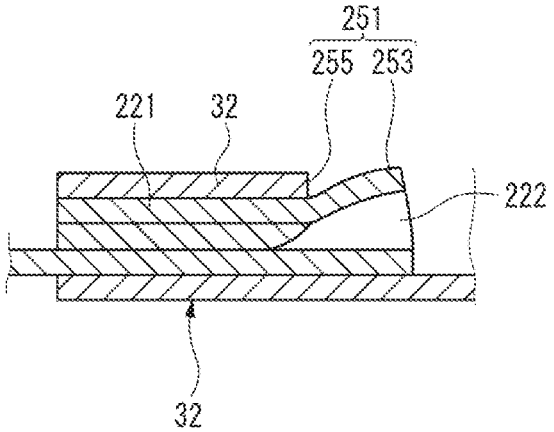
FIG. 14B is a sectional view taken online I-I in FIG. 12B.

Further, as shown in FIG. 14B, the tip portions of the engagement walls 222 in the terminal connection portion 221 exposed on the grounding electric wire D side are not crushed but left as the engagement protruding portions 253 after the fastening caulking pieces 32*a* are caulked and fastened. Thus, the terminal connection portion 221 is prevented from detaching from the fastening caulking pieces 32*a*. That is, when the fastening connection portion 32 is caulked and fastened to the terminal connection portion 221, an engagement mechanism 251 in which the engagement protruding portions 253 abut against the electric-wire-side side faces 255 of the fastening caulking pieces 32*a* is formed.

Thus, as shown in FIGS. 12A and 12B, the engagement mechanism 251 in which the engagement protruding portions 253 abut against the electric-wire-side side faces 255 of the fastening caulking pieces 32*a* can firmly prevent the terminal connection portion 221 from detaching from the fastening caulking pieces 32*a*.

In the aforementioned manner, the connection terminals 230 are caulked and fastened to the terminal connection portions 221 of the terminal fitting 210 respectively. Thus, the grounding electric wires D are conductively connected to the terminal fitting 210 in a lump. When the terminal fitting 210 is fixed to the grounding surface of the vehicle by a bolt, the grounding electric wires D are grounded.

As has been described above, also according to the third embodiment, the terminal connection portion 221 is inserted into the retention space S surrounded by the fastening caulking pieces 32*a* of the connection terminal 230 so that the terminal connection portion 221 can be retained by the connection terminal 230. Thus, the fastening caulking pieces 32*a* can be caulked and fastened in the state where the terminal connection terminal 221 has been retained by the connection terminal 230. As a result, the terminal connection portion 221 can be kept in a stable posture when it is being caulked and fastened. Thus, a variation in crimping strength can be suppressed to obtain high reliability in connection.

In addition, the fastening work can be performed in the state where the posture of the terminal connection portion 221 has been stabilized with respect to the connection terminal 230. Thus, the workability can be improved, and a variation in crimping strength can be suppressed to obtain high reliability in connection. In addition, due to the retention space S formed in advance in the connection terminal 230, the width size can be suppressed in comparison with a case where the fastening caulking pieces 32*a* are formed into a U-shape widened upward. Thus, components including the crimper 43 can be miniaturized to save the working space during fastening by the crimping machine 41.

In addition, also in the connection structure of the terminal fitting according to the third embodiment, the connection terminals 230 connected to a plurality of grounding electric wires D are caulked and fastened to the terminal connection portions 221 of the terminal fitting 210, so that the grounding electric wires D can be conductively connected to the terminal fitting 210 in a lump surely and with high reliability in connection.

In addition, in the same manner as in the first embodiment, it is unnecessary to stack terminal fittings 210. Accordingly, in comparison with a structure in which terminal fittings connected to electric wires respectively are stacked and fastened for conductive connection, increase in weight of the terminal fitting can be suppressed even when the number of electric wires increases. In addition, since it is not necessary to stack terminal fittings, the thickness of the terminal fitting does not increase even when electric wires to be conductively connected increases. Thus, space saving can be attained.

In addition, due to the structure in which separate connection terminals 230 are fastened and connected to the terminal fitting 210, the connection terminals 230 to which grounding electric wires D different in size have been connected can be caulked and fastened to the terminal connection portions 221 to be thereby conductively connected thereto. That is, grounding electric wires D having various sizes can be dealt with without changing the connection forms between the terminal connection portions 221 of the terminal fitting 210 and the fastening connection portions 32 of the connection terminals 230. In addition, when terminal fittings 210 differing in number of terminal connection portions 221 are prepared, it is possible to easily deal with increase or decrease in number of grounding electric wires D to be conductively connected.

That is, also in the connection structure of the terminal fitting according to the third embodiment, a change in number or size of grounding electric wires D to be conductively connected can be dealt with by a required minimum variation of terminal fittings 210.

In addition, due to the structure in which connection terminals 230 are caulked and fastened to a plurality of terminal connection portions 221 of the terminal fitting 210, the connection terminals 230 can be caulked and fastened to the terminal connection portions 221 in accordance with necessity. Thus, the number of grounding electric wires D to be conductively connected in a lump can be increased or decreased easily within the range of the number of terminal connection portions 221.

In addition, the engagement walls 222 that can be engaged with the fastening caulking pieces 32*a* are formed in the opposite side portions of the terminal connection portion 221. Accordingly, when the fastening caulking pieces 32*a* of the connection terminal 230 are caulked to the terminal connection portion 221, the fastening caulking pieces 32*a* are engaged with the engagement walls 222 of the terminal connection portion 221. Thus, the fastening caulking pieces 32*a* are surely crimped on the terminal connection portion 221 so that the connection strength of the connection terminal 230 to the terminal connection portion 221 can be further enhanced. It is therefore possible to stabilize electric resistance at the connection place to thereby improve the electric connection.

Further, since the engagement mechanism 251 for preventing the terminal connection portion 221 from detaching from the fastening caulking pieces 32*a* is provided between the terminal connection portion 221 and the connection terminal 230, the terminal connection portion 221 can be prevented from detaching from the fastening caulking pieces 32*a* when the engagement protruding portions 253 of the terminal connection portion 221 abut against the electric-wire-side side faces 255 of the fastening caulking pieces 32*a*.

Here, the engagement protruding portions 253 forming the engagement mechanism 251 are formed in such a manner that each engagement wall 222 in the terminal connection portion 221 in the terminal insertion direction is made longer than the fastening connection portion 32 so that the tip portion of the engagement wall 222 cannot be crushed but can be left after the fastening caulking pieces 32*a* are caulked and fastened. That is, the engagement mechanism 251 can be formed without changing a terminal processing apparatus or the crimping machine 41 on a large scale. Thus, increase in working cost can be suppressed.

In addition, the terminal connection portions 221 are extended radially within one and the same plane. Accordingly, a large number of terminal connection portions 221 can be provided while suppressing the area occupied by the terminal fitting 210 as much as possible. Thus, a large number of grounding electric wires D can be connected in a lump.

In addition, in the connection structure of the terminal fitting according to the third embodiment, the electric wire connection portion body 219 coupled with the terminal body 211 through the coupling portion 220 is separated for the sake of disassembly. In this manner, the grounding electric wires D can be separated from the terminal body 211 in a lump. Thus, good recycling efficiency can be obtained.

In addition, the locking force with which the coupling portion 220 coupling the terminal body 211 with the electric wire connection portion body 219 is locked by the locking pieces 216*a* can be adjusted. For example, the locking force can be adjusted in accordance with the diameters of grounding electric wires D, the number of the grounding electric wires D to be connected, the wiring condition of the grounding electric wires D, etc. Thus, connection strength during wiring can be secured surely while good separation performance during disassembly can be also secured. Thus, durability and recycling efficiency can be made compatible. For example, the coupling strength between the terminal body 211 and the electric wire connection portion body 219 can be adjusted within a range from strength required as connection strength to strength allowing separation (for example, from 100 N to 500 N).

Forth Embodiment

Next, a connection structure for a terminal fitting according to a fourth embodiment of the invention will be described.

Incidentally, a fixed plate portion 212 has the same structure as in the aforementioned third embodiment. It is therefore referenced correspondingly, and detailed description thereof will be omitted.

Figure 15A:
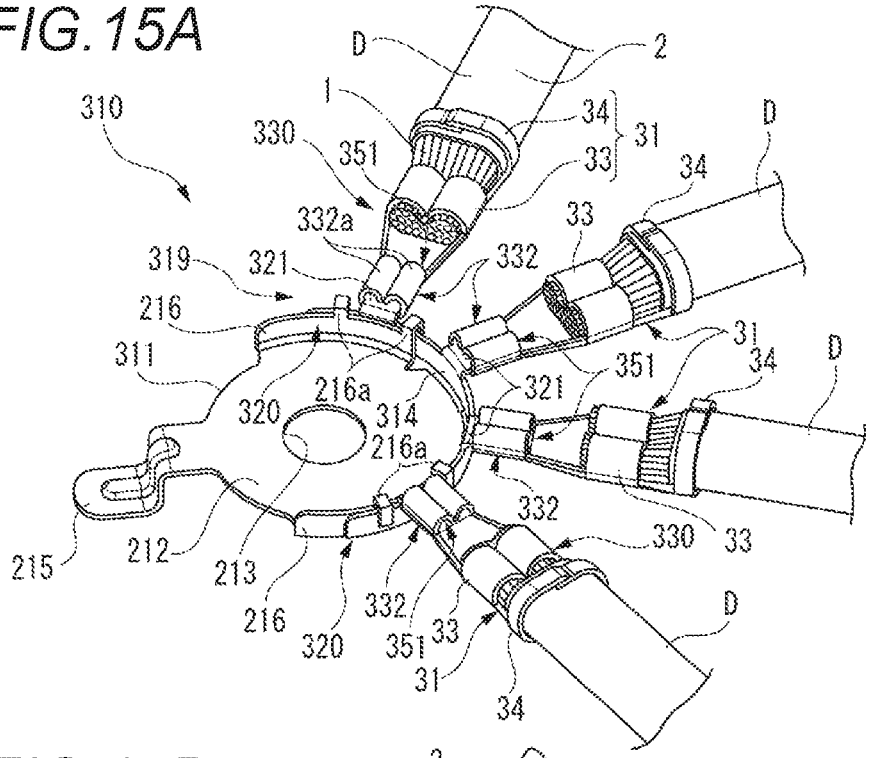
FIGS. 15A and 15B are views for explaining a connection structure for a terminal fitting according to a fourth embodiment of the invention.
Figure 15B:
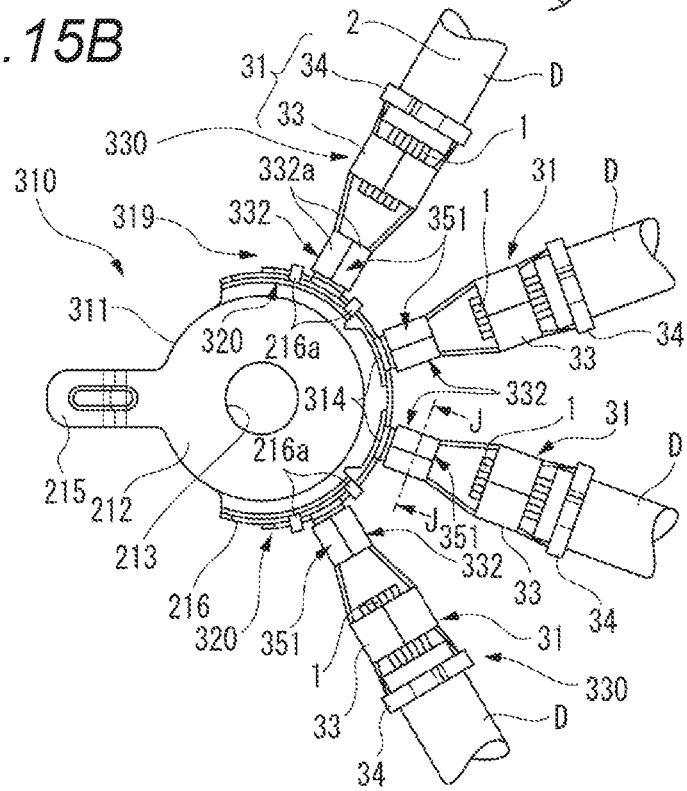
Figure 16:
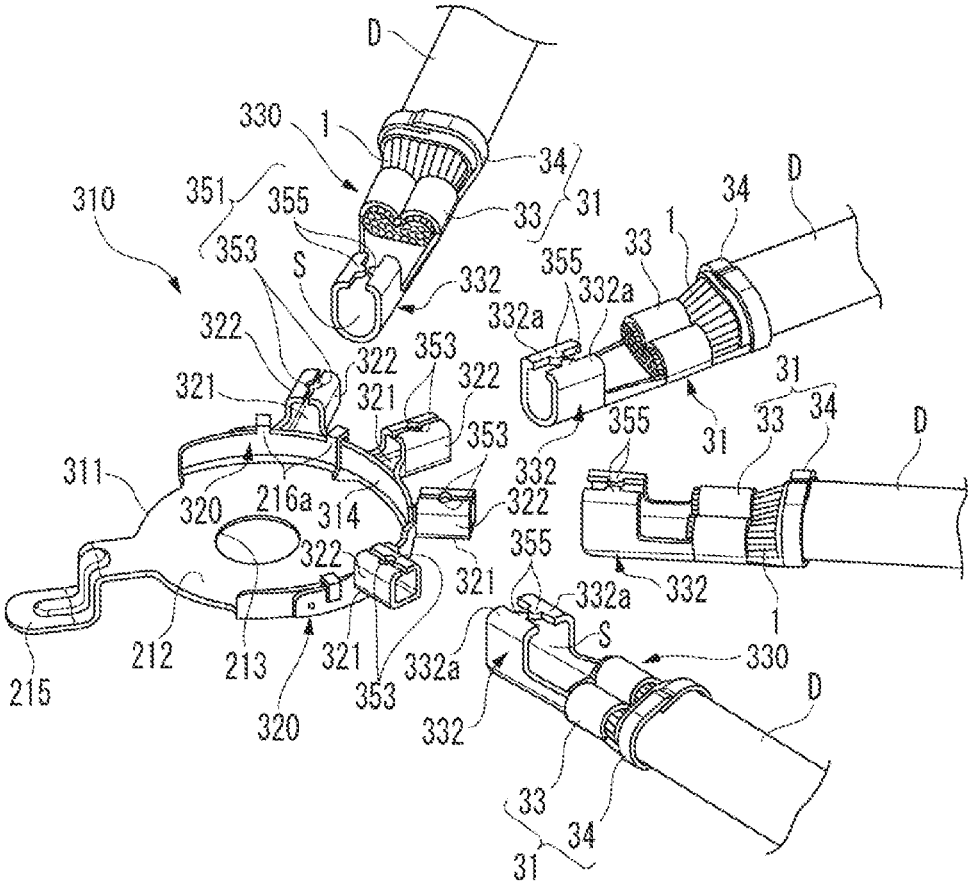
FIG. 16 is a perspective view of the terminal fitting and connection terminals, for explaining the connection structure of the terminal fitting according to the fourth embodiment.

FIGS. 15A and 15B are views for explaining the connection structure of the terminal fitting according to the fourth embodiment. FIG. 15A is a perspective view of a terminal fitting 310 to which grounding electric wires D have been connected, and FIG. 15B is a plan view of the terminal fitting 310 to which the grounding electric wires D have been connected. FIG. 16 is a perspective view of the terminal fitting and connection terminals, for explaining the connection structure of the terminal fitting according to the fourth embodiment.

As shown in FIGS. 15A and 15B and FIG. 16, the terminal fitting 310 has a terminal body 311, and an electric wire connection portion body 319 including a plurality of terminal connection portions 321. The terminal fitting 310 is a press-formed article formed out of a conductive metal plate. The terminal body 311 includes a fixed plate portion 212 having a circular shape in planar view. The terminal body 311 is fixed to a grounding surface of a body or the like of a vehicle by a bolt (not shown) inserted into a mounting hole 213 of the fixed plate portion 212.

In the electric wire connection portion body 319, a connection plate portion 314 having an arc shape in planar view is formed in an approximately half circumferential part of the circumferential edge of the fixed plate portion 212. With respect to the fixed plate portion 212, the connection plate portion 314 is provided erectly on the side of the upper surface which is a one-side surface. The connection plate portion 314 is disposed along the outer circumferential surfaces of support wall portions 216 so that the opposite ends of the connection plate portion 314 can be locked by lock pieces 216*a*. Thus, the connection plate portion 314 is supported by the support wall portions 216.

In this manner, in the terminal fitting 310 according to the fourth embodiment, the parts where the connection plate portion 314 is locked by the lock pieces 216*a* of the support wall portions 216 serve as coupling portions 320. That is, the terminal fitting 310 includes a plurality of coupling portions 320 so that the terminal body 311 can be coupled with the electric wire connection portion body 319 by the coupling portions 320.

Each terminal connection portion 321 is formed integrally with the connection plate portion 314 of the terminal body 311. A plurality of terminal connection portions 321 are provided in the connection plate portion 314. Specifically, three terminal connection portions 321 are formed in the connection plate portion 314. The terminal connection portions 321 are extended, within one and the same plane, from the circumferential edge of the fixed plate portion 212 so as to project radially.

Each terminal connection portion 321 has engagement walls 322 in its opposite side portions. The engagement walls 322 serve as fastened caulking pieces that project on the side of the upper surface which is a one-side surface. Thus, each terminal connection portion 321 is formed into a U-shape in front view. In addition, each engagement wall 322 has an engagement piece 322*a* in its upper end portion. The engagement piece 322*a* is bent inward like an arc.

Further, as shown in FIG. 16 and FIGS. 17A to 17C, engagement concave portions 353 are formed in the tips of the engagement pieces 322*a* so as to forma circular opening between the pair of opposed engagement pieces 322*a*. The engagement concave portions 353 are substantially semicircular notch portions that are formed by notching the tip edges of the engagement pieces 322*a*. The engagement concave portions 353 form an engagement mechanism 351 together with engagement protruding portions 355 provided to protrude in the tips of fastening caulking pieces 332*a* in a fastening connection portion 332 of a connection terminal 330, which will be described later.

Each connection terminal 330 has an electric wire connection portion 31 and a fastening connection portion 332. A grounding electric wire D is connected to the electric wire connection portion 31. The connection terminal 330 provided in the grounding electric wire D is a press-formed article formed out of a conductive metal plate. The fastening connection portion 332 is caulked and fastened to one of the terminal connection portions 321 of the terminal fitting 310.

As shown in FIG. 16 and FIGS. 17A to 17C, the fastening connection portion 332 of the connection terminal 330 has a pair of fastening caulking pieces 332*a*. Each fastening caulking piece 332*a* is provided erectly upward from a bottom portion of the fastening connection portion 332. In addition, the upper end portion of the fastening caulking piece 332*a* is bent inward in an arc shape.

Thus, a retention space S surrounded by the fastening caulking pieces 332*a* is formed in the fastening connection portion 332 of the connection terminal 330. The opposite side faces of the retention space S are formed into substantially vertical faces due to the fastening caulking pieces 332*a* provided erectly upward. The opposite side faces serve as rotation regulation faces 336.

The retention space S of the fastening connection portion 332 is formed to be a little larger than the outer shape of the terminal connection portion 321 in front view. Thus, the terminal connection portion 321 can be inserted into the retention space S. The terminal connection portion 321 inserted into the retention space S abuts against the rotation regulation faces 336 constituted by the opposite side faces forming the retention space S. In this manner, the terminal connection portion 321 can be regulated from rotating around an axis extending in the direction in which the terminal connection portion 321 has been inserted into the retention space S.

In addition, in the fastening connection portion 332, engagement protruding portions 355 are provided to protrude in the tips of the fastening caulking pieces 332*a* respectively. The engagement protruding portions 355 are substantially semicircular protruding pieces provided to protrude at the front edges of the fastening caulking pieces 332*a* correspondingly to the engagement concave portions 353 notched and formed at the front edges of the engagement pieces 322*a*. The engagement protruding portions 355 form the engagement mechanism 351 together with the engagement concave portions 353.

First, in order to connect a grounding electric wire D to the connection terminal 330, a jacket 2 is removed to expose a conductor portion 1 in an end portion of the grounding electric wire D. Then, the end portion of the grounding electric wire D is disposed on the electric wire connection portion 31 of the connection terminal 330, and a conductor caulking portion 33 is caulked while a coating caulking portion 34 is caulked. Thus, the connection terminal 330 is connected to the grounding electric wire D.

Figure 17A:
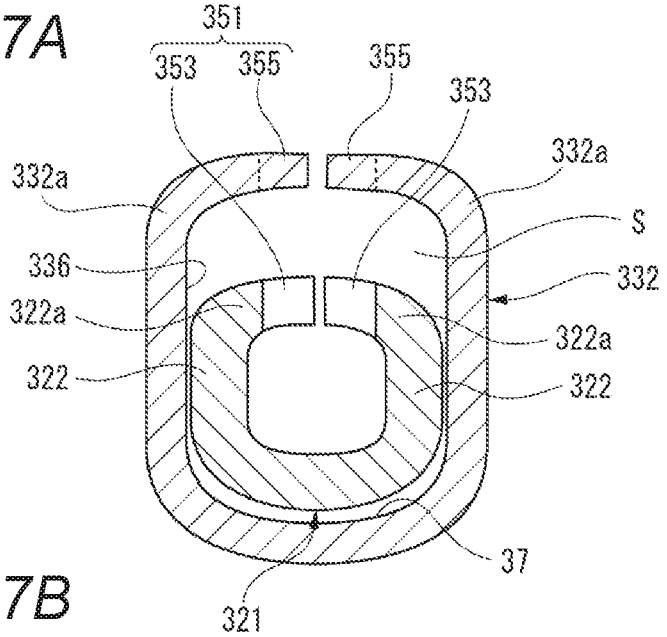
FIGS. 17A to 17C are views each showing a fastening state of fastening caulking pieces of a fastening connection portion to a terminal connection portion of the terminal fitting.

Next, as shown in FIG. 17A, the terminal connection portion 321 of the terminal fitting 310 is inserted into the retention space S of the fastening connection portion 332 of the connection terminal 330 connected to the grounding electric wire so as to be temporarily fixed thereto. Then, the fastening caulking pieces 332*a* are caulked.

Figure 17B:
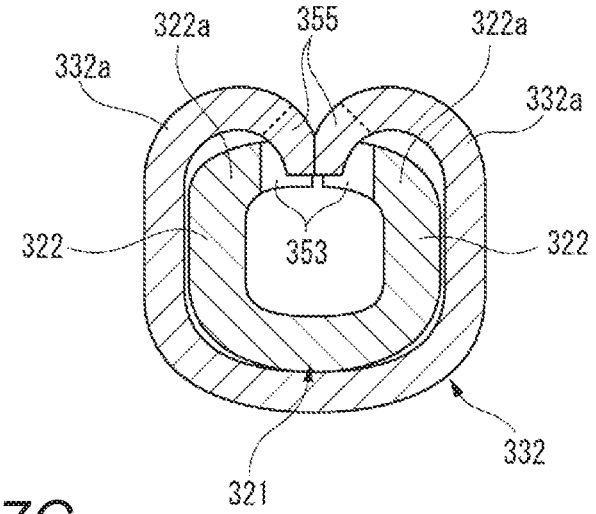

Here, the fastening caulking pieces 332*a* are caulked in the state where the terminal connection portion 321 of the terminal fitting 310 has been disposed in the retention space S of the fastening connection portion 332 of the connection terminal 330. At the start of the caulking, the fastening caulking pieces 332*a* roll up the opposite side portions of the terminal connection portion 321 of the terminal body 311 as shown in FIG. 17B. On this occasion, the engagement protruding portions 355 provided to protrude at the tips of the fastening caulking pieces 332*a* are put into the engagement concave portions 353 of the engagement pieces 322*a*.

Figure 17C:
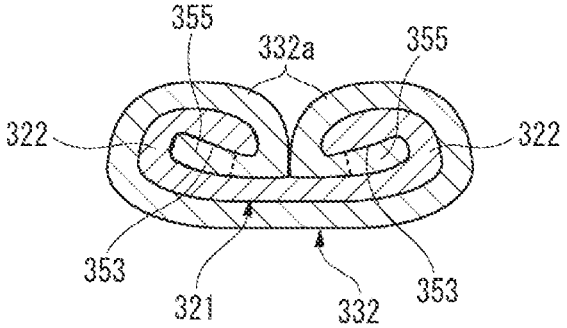

After that, as shown in FIG. 17C, the fastening caulking pieces 332*a* are caulked to roll up the engagement walls 322 of the terminal connection portion 321 from outside. Thus, the engagement walls 322 are rounded inside the fastening caulking pieces 332*a* and received therein tightly so that the fastening connection portion 332 can be filled with the terminal connection portion 321. In addition, still on this occasion, the terminal connection portion 321 is kept in a predetermined posture inside the retention space S with respect to the connection terminal 330. Accordingly, the fastening connection portion 332 is caulked and fastened to the terminal connection portion 321 firmly with high contact pressure, while the terminal fitting 310 and the connection terminal 330 are crimped with good balance and conductively connected surely.

On this occasion, the engagement protruding portions 355 of the fastening caulking pieces 332*a* put into the engagement concave portions 353 of the engagement pieces 322*a* are caulked in the state where the engagement protruding portions 355 have been engaged with the engagement concave portions 355 of the caulked engagement walls 322. Thus, the engagement mechanism 351 for preventing the terminal connection portion 321 from detaching from the fastening caulking pieces 332*a* is formed.

In this manner, due to the engagement protruding portions 355 of the fastening caulking pieces 322*a* engaged with the engagement concave portions 353 of the caulked engagement walls 322, the terminal connection portion 321 is firmly prevented from detaching from the fastening caulking pieces 332*a*.

Incidentally, engagement concave portions and the engagement protruding portions forming the engagement mechanism 351 according to the invention are not limited to notch portions and protruding pieces. Through holes formed in fastened caulking pieces (engagement walls), and raised pieces formed in fastening caulking pieces may be used.

In the aforementioned manner, the connection terminals 330 are caulked and fastened to the terminal connection portions 321 of the terminal fitting 310 respectively. Thus, the grounding electric wires D are conductively connected to the terminal fitting 310 in a lump. When the terminal fitting 310 is fixed to the grounding surface of the vehicle by a bolt, the grounding electric wires D are grounded.

As has been described above, also according to the fourth embodiment, the terminal connection portion 321 is inserted into the retention space S surrounded by the fastening caulking pieces 332*a* of the connection terminal 330 so that the terminal connection portion 321 can be retained by the connection terminal 330. Thus, the fastening caulking pieces 332*a* can be caulked and fastened in the state where the terminal connection terminal 321 has been retained by the connection terminal 330. As a result, the terminal connection portion 321 can be kept in a stable posture when it is being caulked and fastened. Thus, a variation in crimping strength can be suppressed to obtain high reliability in connection.

In addition, the fastening work can be performed in the state where the posture of the terminal connection portion 321 has been stabilized with respect to the connection terminal 330. Thus, the workability can be improved, and a variation in crimping strength can be suppressed to obtain high reliability in connection. In addition, due to the retention space S formed in advance in the connection terminal 330, the width size can be suppressed in comparison with a case where the fastening caulking pieces 332*a* are formed into a U-shape widened upward. Thus, components including the crimper 43 can be miniaturized to save the working space during fastening by the crimping machine 41.

In addition, also in the connection structure of the terminal fitting according to the fourth embodiment, the connection terminals 330 connected to a plurality of grounding electric wires D are caulked and fastened to the terminal connection portions 321 of the terminal fitting 310, so that the grounding electric wires D can be conductively connected to the terminal fitting 310 in a lump surely and with high reliability in connection.

In addition, in the same manner as in the first embodiment, it is unnecessary to stack terminal fittings 310. Accordingly, in comparison with a structure in which terminal fittings connected to electric wires respectively are stacked and fastened for conductive connection, increase in weight of the terminal fitting can be suppressed even when the number of electric wires increases. In addition, since it is not necessary to stack terminal fittings, the thickness of the terminal fitting does not increase even when electric wires to be conductively connected increases. Thus, space saving can be attained.

In addition, due to the structure in which separate connection terminals 330 are fastened and connected to the terminal fitting 310, the connection terminals 330 to which grounding electric wires D different in size have been connected can be caulked and fastened to the terminal connection portions 321 to be thereby conductively connected thereto. That is, grounding electric wires D having various sizes can be dealt with without changing the connection forms between the terminal connection portions 321 of the terminal fitting 310 and the fastening connection portions 332 of the connection terminals 330. In addition, when terminal fittings 310 differing in number of terminal connection portions 321 are prepared, it is possible to easily deal with increase or decrease in number of grounding electric wires D to be conductively connected.

That is, also in the connection structure of the terminal fitting according to the fourth embodiment, a change in number or size of grounding electric wires D to be conductively connected can be dealt with by a required minimum variation of terminal fittings 310.

In addition, due to the structure in which connection terminals 330 are caulked and fastened to a plurality of terminal connection portions 321 of the terminal fitting 310, the connection terminals 330 can be caulked and fastened to the terminal connection portions 321 in accordance with necessity. Thus, the number of grounding electric wires D to be conductively connected in a lump can be increased or decreased easily within the range of the number of terminal connection portions 321.

In addition, the engagement walls 322 that can be engaged with the fastening caulking pieces 332*a* are formed in the opposite side portions of the terminal connection portion 321. Accordingly, when the fastening caulking pieces 332*a* of the connection terminal 330 are caulked to the terminal connection portion 321, the fastening caulking pieces 332*a* are engaged with the engagement walls 322 of the terminal connection portion 321. Thus, the fastening caulking pieces 332*a* are surely crimped on the terminal connection portion 321 so that the connection strength of the connection terminal 330 to the terminal connection portion 321 can be further enhanced. It is therefore possible to stabilize electric resistance at the connection place to thereby improve the electric connection.

Further, since the engagement mechanism 351 for preventing the terminal connection portion 321 from detaching from the fastening caulking pieces 332*a* is provided between the terminal connection portion 321 and the connection terminal 330, the terminal connection portion 321 can be prevented from detaching from the fastening caulking pieces 332*a* when the engagement protruding portions 355 of the fastening caulking pieces 332*a* are engaged with the engagement concave portions 353 of the caulked engagement walls 322.

Here, the engagement concave portions 353 and the engagement protruding portions 355 forming the engagement mechanism 351 can be formed at the same time as the terminal fitting 310 and the connection terminal 330 are press-formed. That is, the engagement mechanism 351 can be formed without changing a terminal processing apparatus or the crimping machine 41 on a large scale. Thus, increase in working cost can be suppressed.

In addition, the terminal connection portions 321 are extended radially within one and the same plane. Accordingly, it is possible to provide a large number of terminal connection portions 321 while suppressing the area occupied by the terminal fitting 310 as much as possible. Thus, a large number of grounding electric wires D can be connected in a lump.

In addition, in the connection structure of the terminal fitting according to the fourth embodiment, the electric wire connection portion body 319 coupled with the terminal body 311 through the coupling portion 320 is separated for the sake of disassembly. In this manner, the grounding electric wires D can be separated from the terminal body 311 in a lump. Thus, good recycling efficiency can be obtained.

Incidentally, in the aforementioned first to fourth embodiments, grounding electric wires of on-vehicle circuits (accessories) are connected to the terminal fitting 10, 110, 210, 310 so that the grounding electric wires D can be grounded in a lump. However, electric wires to be connected to the terminal fitting 10, 110, 210, 310 are not limited to the grounding ones.

In addition, the rotation stopper piece 15, 115, 215 is not provided in the terminal body 11, 111, 211, 311 of the terminal fitting 10, 110, 210, 310, but a step or a rotation stopper piece that can abut against the terminal fitting 10, 110, 210, 310 to thereby serve as a rotation stopper when the terminal fitting 10, 110, 210, 310 is attached to the grounding surface may be provided on the grounding surface side.

Incidentally, the invention is not limited to the aforementioned embodiments, but deformations, improvements, etc. can be made suitably. In addition, materials, shapes, dimensions, numbers, arrangement places, etc. of respective constituent elements in the aforementioned embodiments are not limited. Any materials, any shapes, any dimensions, any numbers, any arrangement places, etc. may be used as long as the invention can be attained.

Here, the features of the aforementioned embodiments of the connection structure of the terminal fitting according to the invention will be summarized and listed briefly in the following paragraphs [1] to [4].

[1] A connection structure for a terminal fitting comprising:

a terminal fitting (10, 110, 210, 310) including a terminal body (11, 111, 211, 311) and a plurality of terminal connection portions (21, 121, 221, 321) extending from the terminal body; and connection terminals (30, 130, 230, 330) connected to electric wires (grounding electric wires D), wherein each of the connection terminals include a pair of fastening caulking pieces (32*a*, 332*a*), wherein the pair of fastening caulking pieces are caulked with opposite side portions of a corresponding one of the terminal connection portions from outside so as to roll up the opposite side portions so that the connection terminal is caulked and fastened to the terminal fitting, wherein the terminal connection portion and the connection terminal includes an engagement mechanism (51, 151, 251, 351) that prevents the terminal connection portion from detaching from the fastening caulking pieces, and wherein the terminal fitting is connected to the electric wires through the connection terminals.

[2] The connection structure for the terminal fitting according to [1], wherein the engagement mechanism includes concave-convex engagement portions (51) respectively provided in opposed surfaces in which the terminal connection portion and the connection terminal abut against each other.

[3] The connection structure for the terminal fitting according to [1], wherein the engagement mechanism (151, 251) includes electric-wire-side side faces (155, 255) of the fastening caulking pieces and engagement protruding portions (153, 253) provided in the terminal connection portions so as to abut against the electric-wire-side side faces.

[4] The connection structure for the terminal fitting according to [1], wherein engagement mechanism (351) includes engagement protruding portions (355) that are formed in the fastening caulking pieces (332*a*) and the engagement concave portions (353) that are formed in the fastened caulking pieces (engagement walls 322) erecting on opposite side portions of the terminal connection portions so as to be engaged with the engagement concave portions (353).

DESCRIPTION OF REFERENCE NUMERALS AND SIGNS

10 terminal fitting, 11 terminal body, 21 terminal connection portion, 22 engagement wall (fastened caulking piece), 30 connection terminal, 32 fastening connection portion, 32*a* fastening caulking piece, 36 rotation regulation face, 37 bottom, D grounding electric wire (electric wire), S retention space

What is claimed is:

1. A connection structure for a terminal fitting comprising:

the terminal fitting including a terminal body and a plurality of terminal connection portions extending from the terminal body; and connection terminals connected to electric wires, wherein each of the connection terminals include a pair of fastening caulking pieces, wherein the pair of fastening caulking pieces are caulked with opposite side portions of a corresponding one of the terminal connection portions from outside so as to roll up the opposite side portions so that the connection terminal is caulked and fastened to the terminal fitting, wherein the terminal connection portion and the connection terminal include an engagement mechanism that prevents the terminal connection portion from detaching from the fastening caulking pieces, and wherein the terminal fitting is connected to the electric wires through the connection terminals.

2. The connection structure for the terminal fitting according to claim 1, wherein the engagement mechanism includes concave-convex engagement portions respectively provided in opposed surfaces in which the terminal connection portion and the connection terminal abut against each other.

3. The connection structure for the terminal fitting according to claim 1, wherein the engagement mechanism includes electric-wire-side side faces of the fastening caulking pieces and engagement protruding portions provided in the terminal connection portions so as to abut against the electric-wire-side side faces.

4. The connection structure for the terminal fitting according to claim 1, wherein the engagement mechanism includes engagement protruding portions that are formed in the fastening caulking pieces and engagement concave portions that are formed in fastened caulking pieces erecting on opposite side portions of the terminal connection portions so as to be engaged with the engagement concave portions.

* * * * *